United States Patent [19]

Adin

[11] 4,273,860

[45] Jun. 16, 1981

[54] INHIBITION OF IMAGE FORMATION UTILIZING COBALT(III) COMPLEXES

[75] Inventor: Anthony Adin, Rochester, N.Y.

[73] Assignee: Eastman Kodak Company, Rochester, N.Y.

[21] Appl. No.: 971,460

[22] Filed: Dec. 20, 1978

Related U.S. Application Data

[63] Continuation-in-part of Ser. No. 865,275, Dec. 28, 1977, abandoned.

[51] Int. Cl.[3] ..... G03C 5/24; G03C 1/00; G03C 1/52

[52] U.S. Cl. ..... 430/338; 430/332; 430/334; 430/936; 430/141; 430/171; 430/495; 430/541; 430/346; 430/348; 430/353; 430/374; 430/351

[58] Field of Search ..... 96/48 R, 75, 88, 91 R, 96/90 R, 27 E, 45.2; 430/936, 332, 334, 141, 171, 495, 541, 346, 348, 353, 374, 351

[56] References Cited

U.S. PATENT DOCUMENTS

| | | | |
|---|---|---|---|
| 2,774,669 | 12/1956 | Marron et al. | 96/49 |
| 3,224,878 | 12/1965 | Klimkowski et al. | 96/49 |
| 3,469,984 | 9/1969 | Bialczak | 96/75 |
| 3,862,842 | 1/1975 | Bissonette | 96/55 |
| 4,075,019 | 2/1978 | Dominh | 96/88 |

FOREIGN PATENT DOCUMENTS

| | | | |
|---|---|---|---|
| 49-6234 | 2/1974 | Japan | 96/48 HD |
| 50-89020 | 7/1975 | Japan | 96/107 |
| 1095568 | 12/1967 | United Kingdom | 96/90 R |

OTHER PUBLICATIONS

Canadian J. Chem., vol. 54, pp. 3685–3692 (1976).
Research Disclosure, No. 12617, Feb. 1975.
Research Disclosure, No. 13023, Oct. 1974.
Research Disclosure, No. 13505, Jul. 1975.
Research Disclosure, No. 15874, Jun. 1977.
Research Disclosure, No. 15246, Dec. 1976.
Research Disclosure, No. 12331, Jul. 1974.

*Primary Examiner*—Won H. Louie, Jr.
*Attorney, Agent, or Firm*—Dana M. Schmidt

[57] ABSTRACT

There is disclosed a cobalt(III) complex-containing photographic composition, element and process which can be made negative-working or positive-working. Featured are an exposure activatible image precursor composition and a photoinhibitor composition capable of inhibiting image formation in the image precursor composition.

50 Claims, 6 Drawing Figures

FIG. 2a
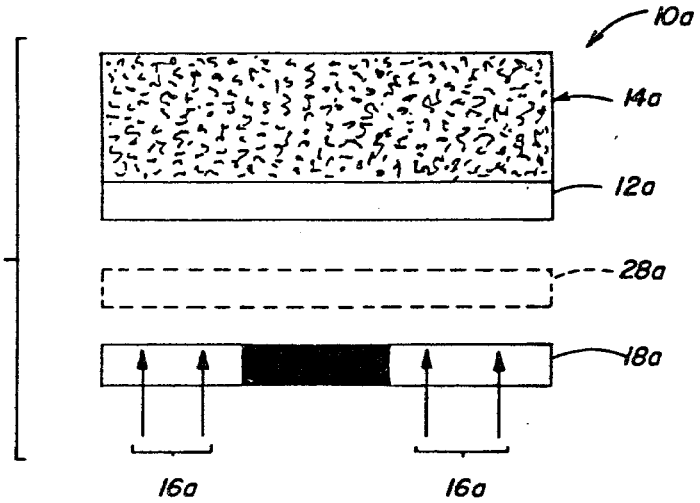
FIG. 2b
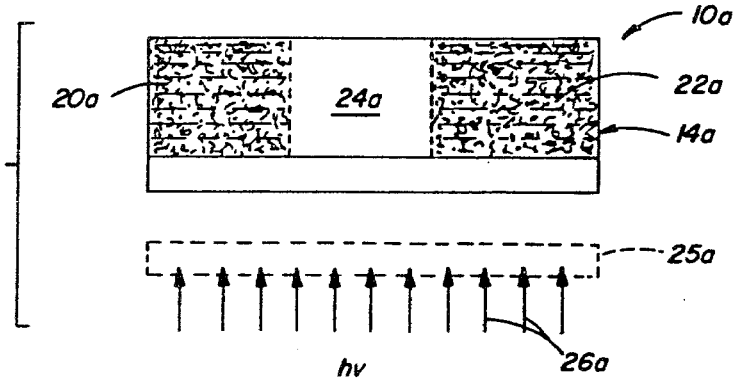
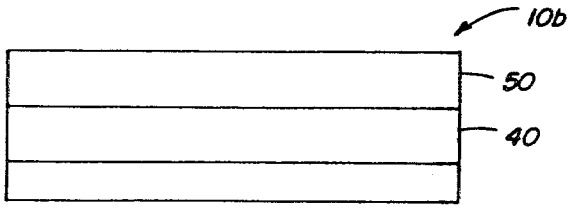
FIG. 3

INHIBITION OF IMAGE FORMATION UTILIZING COBALT(III) COMPLEXES

RELATED APPLICATIONS

This application is a continuation-in-part application of U.S. Ser. No. 865,275 filed Dec. 28, 1977, now abandoned.

BACKGROUND OF THE INVENTION

1. Field of the Invention

This invention relates to a cobalt(III) complex-containing photographic composition, element and process which can be made negative-working or positive-working, depending upon the nature of the exposure given.

2. State of the Prior Art

Cobalt(III) complexes containing releasable ligands have been utilized in non-silver redox reactions photoinitiated by means of photoreductants or spectral sensitizers, as disclosed, for example, in *Reseach Disclosure,* Volumes 126 and 130 October 1974 and February 1975, Publication Nos. 12617 and 13023, respectively, published by Industrial Opportunities Limited, Homewell, Havant Hampshire PO91EF, United Kingdom. Preferred reduction products of such a reaction are cobalt(II) and amines such as ammonia. Either of these can in turn be used to form images, the cobalt(II) being chelated by compounds capable of forming at least bidentate chelates, or the amines being reacted with dye precursors, including diazo-coupler systems, to form a dye; or the cobalt(II) or amines can be used to bleach out preincorporated dye. Such imaging processes are disclosed in *Research Disclosure,* Volume 126, October 1974, Publication No. 12617, part III. Amplification can be achieved by using a reducing agent precursor capable of forming a reducing agent with the aforesaid reduction products, for the reduction of remaining cobalt(III) complexes. For example, certain of said chelating compounds for cobalt(II) form, when chelated, a reducing agent, as described in *Research Disclosure,* Volume 135, July 1975, Publication No. 13505, and o-phthalaldehyde will react with ammonia to form a reducing agent, as disclosed in *Research Disclosure,* Volume 158, June 1977, Publication No. 15874. Imaging elements based upon such reactions involving cobalt(III) complexes are useful, for example, in graphic arts as room-light handling contact films, e.g., as an intermediate in the preparation of printing plates.

The cobalt complex imaging elements of the prior *Research Disclosure* can be either negative-working or positive-working, but the same element is not both. This is, a separate image-forming material (e.g., a dye former) is used in those instances in which the element is to be negative-working, compared to those instances in which the element is positive-working (e.g., by bleaching out a pre-existing dye). It would be highly desirable to provide an imaging element wherein the same element can be made negative or positive working, merely by controlling the processing of the element.

A further aspect of said prior cobalt complex imaging elements is that they can develop background print-up because the unexposed photoinitiator in the background areas causes increased $D_{min}$ (minimum density) upon handling as a result of room light activation of the photoinitiator. To avoid print-up, a peel-apart system can be used, that is, one wherein the layer of cobalt(III) complex relied upon for the imaging is removed from the image recording layer. Print-up is more difficult to avoid in integral systems, particularly when the exposed photoreductant reduces the complex at room temperatures.

Therefore, there is a need for cobalt imaging systems which are less likely to suffer print-up when handled in room light conditions.

Metal complexes capable of releasing amines have been used prior to this invention to thermally activate image recording means such as diazo-coupler compositions. Examples are disclosed in U.S. Pat. Nos. 3,469,984, issued Sept. 30, 1969; 3,224,878, issued Dec. 21, 1965; and 2,774,669, issued Dec. 18, 1956. Because of their thermal instability, such complexes generate amines when overall heated, to cause diazo coupling or the like. There is no disclosure in this art of means for inhibiting such dye development.

*Canadian J. Chem.,* Volume 54, pages 3685 through 3692 (1976), teaches that certain cobalt complexes, specifically $[(NH_3)_5\ Co(III)dimethylsulfoxide]^{3+}$, can be inhibited against thermal reduction by the addition of equimolar concentrations of p-toluenesulfonic acid. No suggestion is made that such acid be photolytically generated.

Patents relating to the background of image formation using amines or cobalt complexes include U.S. Pat. Nos. 2,774,669, issued Dec. 18, 1956; 3,102,811, issued Sept. 3, 1963; 3,469,984, issued Sept. 30, 1969; 3,224,878, issued Dec. 21, 1965; and Japanese Patent Publication No. 74/6234.

SUMMARY OF THE INVENTION

The present invention advantageously features a radiation-sensitive cobalt(III) complex composition, element, and process wherein a single composition can be rendered positive- or negative-working, and wherein undesirable print-up in non-image areas can be avoided. Such features are based upon the discovery that image-producing reactions arising from the release of amines from cobalt(III) complexes can be photolytically inhibited, whereby a negative-working image element can be converted into a positive-working image element. Further, it has been discovered that such photoinhibition can protect non-image areas against print-up.

More specifically, in accordance with one aspect of the invention, there is provided an improved radiation-sensitive composition, and an imaging element containing the same in one or more operatively associated layers, comprising an energy-activatable image precursor composition including at least a cobalt(III) complex containing releasable ligands and an image-forming material capable of generating an image in response to the release of said ligands. The improvement comprises the incorporation into the composition or element, in chemical association with the image precursor composition, of a photoinhibitor capable of inhibiting the ligand release upon exposure to activating radiation of a wavelength longer than about 300 nm, whereby a negative-working or a positive-working image can be produced in the element.

The imaging element of the invention can be used to form a negative or positive image by (a) imagewise activating by selective exposure, one of said image precursor composition and said photoinhibitor composition, whereby either ligands are released or are inhibited from release; and (b) overall activating by exposure the other of the compositions, whereby a negative image or a positive image is produced, respectively.

BRIEF DESCRIPTION OF THE DRAWINGS

FIGS. 2A and 2B are sectional views similar to those of FIGS. 1A through 1C, wherein a negative-working process is demonstrated; and FIG. 3 is a sectional view similar to that of FIG. 1, but illustrating still another embodiment.

DESCRIPTION OF THE PREFERRED EMBODIMENTS

Figure 1A:
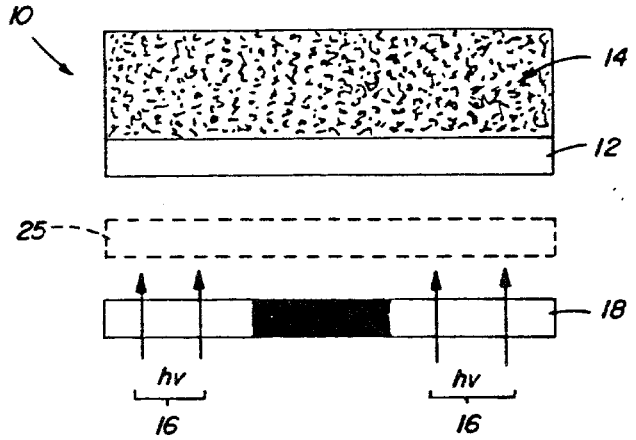
FIGS. 1A through 1C are schematic sectional views of an element of the invention, each view illustrating a step in a positive-working processing of the element in accordance with the invention.

This invention concerns a composition, an imaging element comprising the composition, and a process using that element or composition, wherein an exposure activates an image precursor composition comprising at least a cobalt(III) complex containing releasable ligands, to form an image, and wherein an inhibiting exposure photolytically generates the means for inhibiting such ligand release. More specifically, it has been discovered that a photoinhibitor composition such as a photolytic acid generator will inhibit after suitable exposure the release of ligands which would otherwise occur by the exposure of the image precursor composition.

An "image precursor composition", as used herein, is a composition as described which when appropriately activated by exposure, produces an image by generating either a density or by destroying a pre-existing density. Also as used herein, the precursor composition is "energy-activatible", if not otherwise limited, if it is activatible by electromagnetic energy of any kind to produce, directly or indirectly, the formation of density or the destruction of density in the image precursor composition, where not inhibited by exposed photoinhibitor of the invention. E.g., thermal, light or electrical exposures of the type disclosed, for example, in *Research Disclosure,* Volume 147, July 1976, Publication No. 14719, can be used, depending upon the circumstances. Such exposure, if in the form of heat, can occur through the use of infrared radiation or convection, but preferably it is achieved through conduction to activate an image-forming reaction operative in the composition in question. Unless otherwise stated, "activating" includes all steps necessary to complete the intended function, which in the case of the precursor composition, includes any supplemental image development step, such as heating, that might be desirable.

As will be readily apparent, exposure of the image precursor composition is achieved by an energy form, such as a range of wavelengths, that is different from that used to activate the photoinhibitor.

In a highly preferred form, the exposure of the image precursor composition is achieved through the use of light or heat or both together. However, as noted, if light is used or is present in a thermal exposure, preferably it is of a wavelength or an intensity incapable of activating the photoinhibitor composition. Similarly, the light exposure used to imagewise activate the photoinhibitor composition to inhibit image formation can include light or thermal radiation of wavelengths and intensities that are incapable of activating the image precursor composition in preference to the photoinhibitor composition, as shown in examples hereinafter described. To insure such discrimination, filters may be used, particularly for broad-band exposures. Preferably, the image precursor composition exposure, if thermal, is generated in a total absence of light, such as by a hot block, hot stylus, or heated rollers in a dark room.

As used herein, "photoinhibitor composition" means a single compound or a mixture of compounds which respond to activating radiation having a wavelength greater than about 300 nm, to inhibit the release of ligands by the cobalt(III) complex The photoinhibitor composition can comprise one or more compounds which themselves have a sensitivity that responds to wavelengths longer than about 300 nm, or it can comprise a compound whose sensitivity responds only to wavelengths shorter than about 300 nm, and a spectral sensitizer which increases the native sensitivity to beyond 300 nm.

An imaging element containing the radiation-sensitive composition of the invention can comprise one or more operatively associated layers, with the image precursor composition being contained in one or more of the layers. That is, the image-forming material of the image precursor composition can either be admixed with the photoinhibitor composition, or it can be in a separate, adjacent layer where it responds to the ligands which are released by the cobalt(III) complex, as is more fully described hereafter. Thus, the photoinhibitor composition and the image precursor composition are in chemical association, that is, are either admixed together in a single layer, or are in contiguous layers either as manufactured or as processed.

The aforementioned layers are preferably carried on a support, except for layers which are self-supporting and therefore do not require a support.

Image Precursor Composition

This composition includes at least (1) a cobalt(III) complex containing releasable ligands and (2) an image-forming material capable of generating an image upon release of said ligands If such a cobalt(III) complex is thermally stable, i.e., it will not release ligands in response to an exposure which is primarily thermal in nature, then one or more destabilizer materials preferably is included, as defined and described hereafter.

An amplifier can also be included in the image precursor composition. As used herein, an "amplifier" is a reducing agent precursor composition or compound which interacts with the image precursor composition to generate additional initiators of the imaging reaction whereby an internal gain, usually expressed as enhanced density, is achieved compared to that which results without amplifier. Preferably, the initiators so generated are amines, and a highly useful example of an amplifier for generating such additional amine initiators is phthalaldehyde. The reason for such preference is that phthalaldehyde also functions as an image-forming material, as is hereinafter described. Alternatively, the amplifiers can be compounds which chelate with the cobalt(II) produced from coblt(III), if such chelating compounds contain conjugated $\pi$-bonding systems capable of forming with such cobalt(II), additional reducing agents for remaining cobalt(III) complexes. Typical amplifiers of this class, and necessary restrictions concerning pKa values of the anions that can be used in the cobalt(III) complex in such circumstances, are described in *Research Disclosure,* Vol. 135, July, 1975, Publication No. 13505, the details of which are expressly incorporated herein by reference.

Any cobalt(III) complex containing releasable ligands and which is thermally stable at room temperature will function in this invention, whether or not it is thermally stable within the processing temperatures used. Such complexes on occasion have been described as being "inert". See, e.g., U.S. Pat. No. 3,862,842, Columns 5 and 6. However, the ability of such complexes to remain stable i.e., retain their original ligands when stored by themselves or in a neutral solution at room temperature until a chemically or thermally initiated reduction to cobalt(II) takes place, is so well known that the term "inert" will not be applied herein.

Such cobalt(III) complexes feature a molecule having a cobalt atom or ion surrounded by a group or atoms, ions or other molecules which are generically referred to as ligands. The cobalt atom or ion in the center of these complexes is a Lewis acid while the ligands are Lewis bases. While it is known that cobalt is capable of forming complexes in both its divalent and trivalent forms, trivalent cobalt complexes—i.e., cobalt(III) complexes—are employed in the practice of this invention, since the ligands are relatively tenaciously held in these complexes, and released when the cobalt is reduced to the (II) state.

Preferred cobalt(III) complexes useful in the practice of this invention are those having a coordination number of 6. A wide variety of ligands can be used with cobalt(III) to form a cobalt(III) complex. The one of choice will depend upon whether the image-forming material described hereinafter relies upon amines to generate a dye or the destruction of dye, or upon the chelation of cobalt(II) form a dye density. In the latter case, amine ligands or non-amine ligands can be used, whereas in the former case amine ligands are preferred as the source of initiators for the image-forming reaction. Useful amine ligands include, e.g., methylamine, ethylamine, ammines, and amino acids such as glycinato. As used herein, "ammine" refers to ammonis specifically, when functioning as a ligand, whereas "amine" is used to indicate the broader class noted above. Highly useful with all the embodiment of the image precursor composition hereinafter decribed are the ammine complexes. The other amine complexes achieve best results when used with particular destabilizer materials hereinafter described, for example, photoreductants.

The cobalt(III) complexes useful in the practice of this invention can be neutral compounds which are entirely free of either anions or cations. As used herein, "anion" refers to non-ligand anions, unless otherwise stated. The cobalt(III) complexes can also include one or more cations and anions as determined by the charge ueutralization rule. useful cations are those which produce readily soluble cobalt(III) complexes, such as alkali metals and quaternary ammonium cations.

A wide variety of anions can be used, and the choice depends in part on whether or not an amplifier is used which requires that the element be free of anions of acids having pKa values greater than about 3.5. Otherwise, the choice of anions is significant only to the extent that it determines whether or not the complex is thermally stable when heated to the temperature at which the composition or element is processed. As used herein, "thermal instability" or "thermally unstable" means that the complex decomposes at the temperature in question, hereinafter called the instability temperature, sufficiently to release enough ligands to start the intended reaction of the image precursor composition, as described herein. If the complex is intended to be thermally unstable, it is preferred that it become unstable at temperatures greater than about 100° C. If it is intended to be thermally stable, so as to be used with a destabilizer material, it is preferred that it is stable at temperatures at least as high as about 130° C. Those that are thermally unstable in this range are themselves useful, with the image-forming material, as the image precursor composition. That is, such a complex alone will generate amines when the element or composition containing the complex is heated to the instability temperature. The complex undergoes a reduction to a cobalt(II) in such a case. Because this alone releases the amines, no destabilizer material is required. Alternatively, an amplifier such as phthalaldehyde also can be included.

The anions which tend to render the complex thermally unstable include those that decompose readily to a radical, such as trichloroacetate; those forming unstable heavy metal salts, such as azido; which are themselves reducing agents, such as 2,5-dihydroxy-benzoate, N,N-dimethyl-dithiocarbamate, and 1-phenyl-tetrazolyl-5-thiolate.

It will be appreciated however that thermally unstable complexes, within the temperature range noted, should not be selected from compositions or materials which would destabilize, i.e., release the ligands, in the presence of an acid, because most if not all of the photoinhibitors hereinafter described appear to function by reason of photogeneration of an acid.

Representative examples of complexes containing ligands which are reported as becoming thermally unstable above 100° C. are listed below:

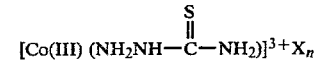

$[Co(III)\ (NH_2NH-\overset{\overset{S}{\|}}{C}-NH_2)]^{3+}X_n$ $[Co(III)\ (NH_3)_3\ (N_3)_3]$
$[Co(III)\ (NH_3)_5\ (C_2O_4)]^{1+}X_n$
$[Co(III)\ (NH_3)_4\ (C_2O_4)]^{1+}X_n$
$[Co(III)\ (NH_3)_2\ (C_2)_4O_2]^{1-}{}_{Xn}$
$[Co(III)\ (NH_3)_3\ (H_2O)\ (C_2O_4)]^{1+}X_n$
$[Co(III)\ (NH_3)_4\ (NO_2)\ (N_2H_4)]^{2+}X_n$

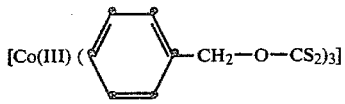

$[Co(III)\ (C_6H_4-CH_2-O-CS_2)_3]$ $[Co(III)\ (NH_3)\ (H_2O)_3]^{3+}X_n$
$[Co(III)\ (NH_3)_3\ Cl_3]$ wherein X is a suitable anion and n is the number of anions necessary to satisfy the charge neutralization rule.

Except for the special condition of thermal instability noted above, any anion can be selected if an anion is necessary for charge neutralization, provided the anion is compatible. As used herein, anions are considered "compatible" if they do not spontaneously cause a reduction of the cobalt(III) complex at room temperature. As noted, a complex does not require anions if it is already neutral.

The following Table II is a partial list of particularly preferred cobalt(III) complexes within the scope of the invention. The suffix (U) designates those which are thermally unstable above about 100° C.

TABLE II—COBALT(III) COMPLEXES hexa-ammine cobalt(III) benzilate
hexa-ammine cobalt(III) thiocyanate
hexa-ammine cobalt(III) trifluoroacetate
chloropenta-ammine cobalt(III) perchlorate
bromopenta-ammine cobalt(III) perchlorate
aquopenta-ammine cobalt(III) perchlorate
bis(methylamine) tetra-ammine cobalt(III) hexafluorophosphate
bis(dimethylglyoxime)bispyridine cobalt(III)trichloroacetate (U)
bis((dimethylglyoxime)ethylaquo cobalt(III)
cobalt(III)acetylacetonate
tris(2,2'-bipyridy)cobalt(III)perchlorate
aquopenta(methylamine)cobalt(III) nitrate (U)
chloropenta(ethylamine)cobalt(III) perfluorobutyrate (U)
trinitrotris-ammine cobalt(III)
trinitrotris(methylamine)cobalt(III) (U)
$\mu$-superoxodeca-ammine dicobalt(III) perchlorate (U)
penta-ammine carbonato cobalt(III) perchlorate
tris(glycinato)cobalt(III)

The image-forming material of the image precursor composition can comprise compounds or compositions in addition to the cobalt(III) complex and destabilizer material, if any, or it can be the same compound as is used as a destabilizer material. It can be a dye-forming material, or a dye which is bleachable. Examples of dye-forming materials which also comprise destabilizer materials used to interact with the cobalt(III) complex, as discussed hereinafter, include 4-methoxynaphthol, which forms a blue dye when oxidized, and protonated diamine destabilizer material which when associated with a conventional color coupler will form a dye when it is oxidized by the reduction of the cobalt(III) complex. Examples of image-forming materials used in addition to a destabilizer material include phthalaldehyde, also used as an amplifier; an ammonia-bleachable or color-alterable dye (cyanine dyes, styryl dyes, rhodamine dyes, azo dyes, and pyrylium dies); a dye-precursor such as ninhydrin; or a diazo-coupler system. Details of these examples are set forth in *Research Disclosure,* Volume 126, October 1974, Publication No. 12617, Part III, noted above. Still another alternative is to admix with the cobalt (III) complex, chelating compounds which will react with cobalt(II) to form a dye.

Ammonia-bleachable image-forming materials will, of course, produce an absence of dye in the exposed areas. As will be readily apparent, ammonia-bleachable, image-forming materials and color-alterable image-forming materials, when incorporated into an element, preferably are used in a separate adjacent layer that is associated with the photo-inhibitor layer after the latter is exposed.

As noted above, the image precursor composition includes destabilizer materials in those instances wherein the cobalt(III) complex is thermally stable. As is implied by the term, destabilizer materials are those which render the otherwise thermally stable cobalt(III) complex susceptible to release of the ligands when appropriately exposed. The exact mechanism by which these destabilizer materials cause the release of the ligands from the cobalt complex is not understood in most instances, other than that such release does occur and cobalt (II) is produced, except where inhibited by the photoinhibitor photoproducts. Because the mechanism of these destabilizer materials is largely uncertain, the subclasses under which various examples fall are uncertain and not necessarily mutually exclusive. To be useful, the destabilizer materials must be compatible with the cobalt (III) complex. Usually, this is not a problem, "compatible destabilizer materials" being used here to mean materials that do not interfere with the complex, such as by precipitating it or by spontaneously reducing it.

Examples of destabilizer materials useful with the complex include organo-metallics such as ferrocene and 1,1-dimethylferrocene, and tricarbonyls such as N,N-dimethylaniline chromium tricarbonyl, as well as organic materials, and may or may not require an amplifier such as phthalaldehyde. For example, destabilizer materials comprising 4-phenyl catechol and quinone photoreductants, hereinafter described, do not require the use of an amplifier compound. Other destabilizer materials will not release the ligands, when appropriately exposed, in amounts sufficient to generate observable dye in the same or an adjacent layer without the presence of an amplifier such as phthalaldehyde. Still other destabilizer materials may release sufficient ligands to cause some dye formation, and at least some of these destabilizer materials can achieve much higher density if an amplifier is included. Therefore, in many of the embodiments of the invention, phthalaldehyde comprises part of the image precursor composition, for preferred results, whether or not it actually is required to produce observable results.

The behavior of phthalaldehyde in an image precursor composition appears to involve, in the preferred embodiments, the formation with ammonia of a reducing agent adduct, structure (A) below, which itself causes reduction of remaining cobalt(III) complexes and release of more ligands. Such release produces an internal gain.

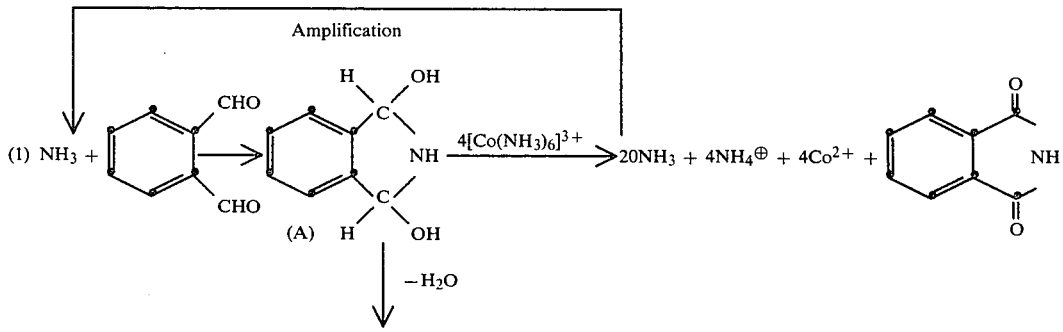

-continued (2)

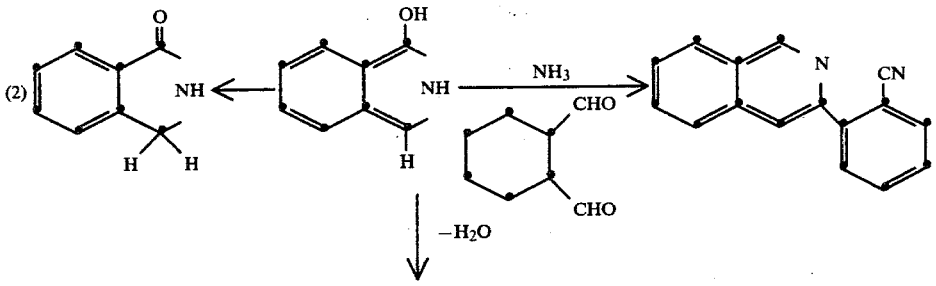

(3)

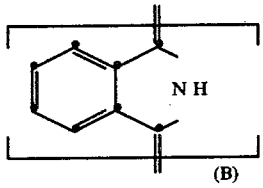

The initial $NH_3$ comes from the cobalt(III) complex on exposure, either because of its own thermal instability, or because of an attack by other destabilizer materials, by one of several mechanisms described hereafter. Because of oligomer (B), phthaladehyde also forms a dye imaging material, in addition to its amplifying function as a reducing agent precursor for cobalt(III). Further explanation can be found in DoMinh et al, "Reactions of Phthalaldehyde with Ammonia and Amines", *J. Org. Chem.* Vol. 42, Dec. 23, 1977, p. 4217.

Useful destabilizer materials which represent thermally responsive organic materials include the following as well as equivalents thereof:

(a) 4-phenyl catechol;

(b) sulfonamidophenols and naphthols such as 4-phenylsulfonamido-2,6-dichlorophenol and 4-phenylsulfonamido-2-methyl-1-naphthol;

(c) other aromatic alcohols such as 4-methoxynaphthol and 1,4-dihydroxynaphthalene;

(d) pyrazolidones such as 4-hydroxymethyl-4-methyl-1-phenyl-3-pyrazolidone, 1-phenyl-4,4-dimethyl-3-pyrazolidone and the like;

(e) acids having the formula:

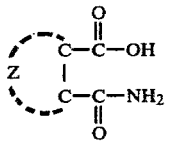

wherein:

Z is from about 4 to about 8 carbon atoms necessary to complete 1 or more aromatic or carbocyclic rings, such as a benzene, naphthalene or cyclohexane ring;

suitable examples of such acids including, for example, phthalamic acid, 2-carboxy-cyclohexylcarboxyamide and amine salts thereof, including 2-carboxy-cyclohexylcarboxyamide triethanolamine salt, and the like;

(f) ureas having the formula:

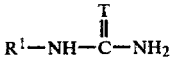

wherein:

T is S or O;

$R^1$ is H or the group:

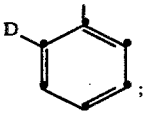

and D is —OH or

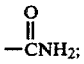

suitable examples of (f) including thiourea, 2-hydroxyphenyl urea and the like;

(g) salts having the formula:

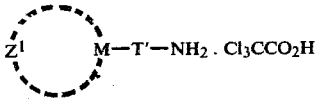

wherein:

M is C or N,

T' is a carbon to nitrogen bond or is alkylene containing from 1 to 3 carbon atoms, and $Z^1$ is from about 4 to about 6 nonmetallic atoms necessary to form an aromatic or heterocyclic ring;

suitable examples of such salts including 1-(β-aminoethyl)-2-imidazolidinone trichloroacetate, 2-amino-2-thiazoline trichloroacetate, anilinium trichloroacetate and the like;

(h) morpholine precursors having the formula:

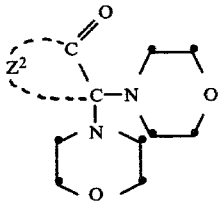

wherein $Z^2$ represents from about 4 to about 8 atoms required to complete a heterocyclic ring; one example of such precursors being 3,3-bis(morphilino)oxindole;

(i) aminimides in polymeric or simple compound form containing the structure:

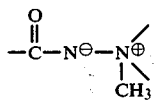

including, for example,

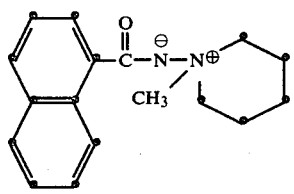

(trialkylamine) cinnamimides;
bis(dialkyl-2-hydroxypropylamine) adipimides;
(dialkyl-2-hydroxypropylamine) palmitimides or laurimides;
bis(trialkylamine) sebacimides or azelamides;
2,2'-(p-phenylenebis-β-acryloyl)-bis-[1-hydroxypropyl-1,1-dimethylhydrazinium] dihydroxide bis (inner salt);
polymers having a repeating unit of the formula

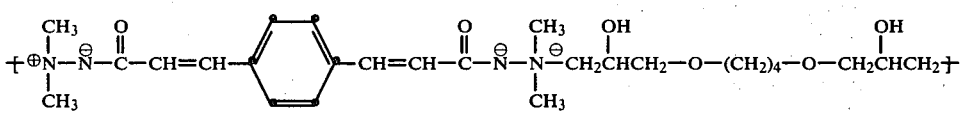

polymers having repeating units with pendant aminimide groups such as:

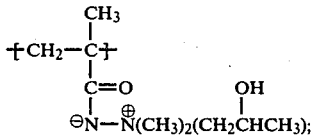

those described in U.S. Pat. No. 4,016,340, issued Apr. 5, 1977, and in *Research Disclosure,* Vol. 157, May 1977, Publication Nos. 15732, 15733 and 15776;
(trialkylamine) arylimides such as (trimethylamine) benzimide and (trimethylamine) naphthimide,
including arylimides substituted with hydroxy, lower alkyl or nitro;
and trialkylamine aryl sulfonimides such as trimethylamine-p-toluenesulfonimide;
(j) triazoles having the formula:

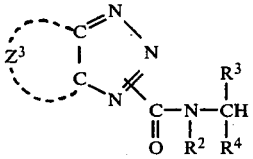

wherein:
$R^2$ has H or alkyl having from 1 to about 5 carbon atoms, such as methyl, ethyl, iso-propyl and the like;
$R^3$ and $R^4$ are either both hydrogen or taken together form an aromatic, carbocyclic or heterocyclic ring; and
$Z^3$ is from about 4 to about 8 nonmetallic atoms necessary to complete one or more substituted or unsubstituted aromatic rings;
such triazoles including, for example, 5-methyl-1-(2)-N-(phenylcarbamoyl)benzotriazole, 5,6-dichloro-1-(2)-N-(dimethyl carbamoyl) benzotriazole;
(k) thiolate precursors having the formula:

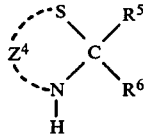

wherein $R^5$ is lower alkyl containing from 1 to about 5 carbon atoms, for example, methyl, ethyl, propyl and the like; $R^6$ is carboxamide or an unsubstituted heterocyclic or aromatic ring or substituted aromatic ring containing from about 6 to 8 nonmetallic ring atoms, for example, 2-pyridyl, phenyl, 4-nitrophenyl and the like; and $Z^4$ is the nonmetallic atoms required to complete a carbocyclic, substituted aromatic, or unsubstituted aromatic ring containing from about 4 to about 9 atoms; examples of such precursors including thiazolidines, such as 2-methyl-2-carboxamidothiazolidine, substituted benzothiazolines such as 2-methyl-2-[2-pyridyl]-benzothiazoline and 2-methyl-2-[4-nitrophenyl]-benzothiazoline;
(l) blocked mercaptotetrazoles having the formula:

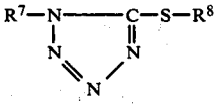

wherein $R^7$ is phenyl or hydrogen and $R^8$ is a heat-removable group selected from the group consisting of:

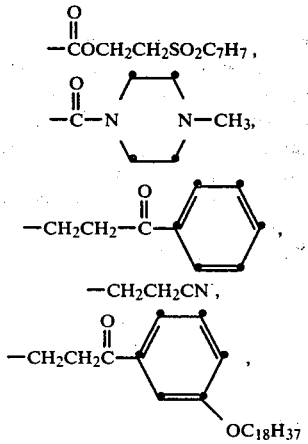

-continued

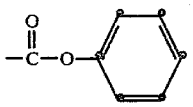

(m) cyclic imides having the structure:

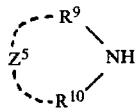

wherein $Z^5$ is from about 2 to about 6 atoms necessary to complete one or more heterocyclic rings, and $R^9$ and $R^{10}$ are the same or different and are each carbonyl or methylidyne; such cyclic imides including, for example succinimide, hydantoin and substituted hydantoin, phthalimide, oxazolinedione and the like;

(n) barbiturates such as 5-n-butylbarbituric acid, and those having the structure:

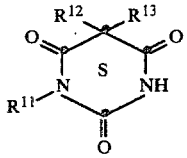

wherein $R^{11}$ is hydrogen or alkyl containing from 1 to about 5 carbon atoms, such as methyl, ethyl, propyl and the like;

$R^{12}$ is hydrogen, alkyl containing from 1 to about 5 carbon atoms such as methyl, ethyl, propyl, n-butyl and the like; and $R^{13}$ is alkyl containing from 1 to about 5 carbon atoms, such as methyl, ethyl, propyl and the like or aralkyl such as benzyl, etc;

(o) protonated arylene diamines having the structure

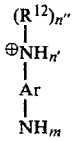

wherein $R^{12}$ is as defined above, Ar is a substituted or unsubstituted arylene group containing from 6 to about 20 carbon atoms, and m is 2 or 3; n′ is 1, 2 or 3; and n′ and n″ equals 3, such as for example, protonated p-phenylene diamine, such diamines being characterized by a loss of the extra proton when heated, creating the unprotonated form which undergoes a redox reaction with the cobalt(III) complex;

and (p) polymers having a repeating unit with the structure

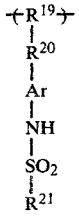

wherein $R^{19}$ is an organic polymeric backbone;

$R^{20}$ is an organic moiety or a carbon-to-carbon bond;

Ar is arylene including substituted arylene, such as phenylene and naphthylene, wherein the substituents, if any, are electron withdrawing groups such as nitro, sulfoalkyl containing from 1 to 5 carbon atoms, halogen such as chloride, fluoride and the like, and substituted alkyl such as trihalosubstituted methyl;

and $R^{21}$ is alkyl containing from 1 to 3 carbon atoms; and the like.

All of the preceding are thermally responsive and induce the release of the ligands from the cobalt(III) complex in the presence of heat. As noted, they may or may not require the presence of an amplifier-dye former such as phthalaldehyde. Some of them, such as destabilizer materials (a) through (d), are quite clearly reducing agents per se; some like destabilizer materials (k) are heat-responsive reducing agent precursors; some, such as destabilizer material (e) and others are heat-responsive amine precursors particularly useful with amine-responsive reducing agents and reducing agent precursors, such as phthalaldehyde, that form reducing agents in the presence of amines; and some such as destabilizer materials (h), (i) and (j) are believed to be base precursors which in the presence of heat form a base. Those which are direct reducing agents (e.g., destabilizer materials (a) through (d)) do not require the presence of an amplifier such as phthalaldehyde, although an amplifier is effective even with these to increase the speed of an element or composition of the invention which incorporates the same.

Yet another class of destabilizer materials useful in inducing the release of amines from the cobalt complex are quinone photoreductants. The quinones which are particularly useful as photoreductants include ortho- and para-benzoquinones and ortho- and para-naphthoquinones, phenanthrenequinones and anthraquinones. The quinones may be unsubstituted or incorporate any substituent or combination of substituents that do not interfere with the conversion of the quinone to the corresponding reducing agent. A variety of such substituents are known to the art and include, but are not limited to, primary, secondary and tertiary alkyl, alkenyl and alkynyl, aryl, alkoxy, aryloxy, alkoxyalkyl, acyloxyalkyl, aryloxyalkyl, aroyloxyalkyl, aryloxyalkoxy, alkylcarbonyl, carboxy, primary and secondary amino, aminoalkyl, amidoalkyl, anilino, piperindino, pyrrolidino, morpholino, nitro, halide and other similar substituents. Aryl substituents are preferably phenyl substituents and alkyl, alkenyl and alkynyl substituents, whether present as sole substituents or present in combination with other atoms, typically contain about 20 of fewer (preferably 6 or fewer) carbon atoms.

A preferred class of photoreductants are internal hydrogen source quinones; that is, quinones incorporating labile hydrogen atoms. These quinones are more easily photoreduced than quinones which do not incorporate labile hydrogen atoms.

Particularly preferred internal hydrogen source quinones are 5,8-dihydro-1,4-naphthoquinones having at least one hydrogen atoms in each of the 5- and 8-ring positions. Other preferred incorporated hydrogen source quinones are those which have a hydrogen atom bonded to a carbon atom to which is also bonded the oxygen atom of an oxy substituent or a nitrogen atom of an amine substituent with the further provision that the carbon-to-hydrogen bond is the third or fourth bond removed from at least one quinone carbonyl double bond. As employed in the discussion of photoreductants herein, the term "amine substituent" is inclusive of amide and imine substituents.

Further details and a list of useful quinone photoreductants of the type described above are set forth in *Research Disclosure,* Volume 126, October 1974, Publication No. 12617, published by Industrial Opportunities Limited, Homewell, Havant Hampshire PO91EF, United Kingdom, the contents of which are hereby expressly incorporated by reference. Still others which can be used include 2-isopropoxy-3-chloro-1,4-naphthoquinone and 2-isopropoxy-1,4-anthraquinone.

As noted above, photoreductants do not require the use of an amplifier, but such a use gives improved results.

It will be appreciated from the foregoing that, unlike the other reducing agent precursors or other destabilizer materials described heretofore, the quinone photoreductants rely upon a light exposure between about 300 nm and about 700 nm to form the reducing agent which reduces the cobalt(III) complex. It is to be noted that thermal irradiation is not needed, after the light exposure, to cause the redox reaction to take place. However, an additional thermal exposure can be used as part of the activation to drive the reaction to a more timely completion. Furthermore, heat is desirable to develop the formation of dye B described above.

Some of the aforedescribed destabilizers, particularly those that respond to thermal radiation, can be enhanced by the inclusion of N,N-bis(2-hydroxyethyl)-dodecanamide.

Photoinhibitor Composition

The radiation to which the photoinhibitor composition is responsive is selected to be longer than 300 nm. because when plastic film used as a support for the imaging element, or the optical glass useful in exposing the element, is used with lower wavelengths, such film or glass absorbs the lower wavelength radiation. As noted above, however, a response to radiation of wavelengths longer than 300 nm. can be achieved even with photoinhibitor compounds having a sensitivity below 300 nm, when used with an appropriate spectral sensitizer. Contemplated representative examples of photoinhibitor compounds of less than 300 nm. sensitivity include carbon tetrabromide, 2-tribromomethyl sulfonylbenzothiazole, 2-bromo-2-tosylacetamide, 2,2-dibromo-2-phenyl-sulfonylacetamide, $\beta$-tribromoethanol and 2-bromo-2-nitro-1,3-trimethylene glycol dibenzoate. Spectral sensitizers that are contemplated as being useful with such photoinhibitor compounds include those disclosed in U.S. Pat. No. 3,503,745 issued Mar. 31, 1970 to Y. Yamada et al, e.g., rhodamines, carbocyanine and cyanine dyes, Eosin and Erythrosin, triphenylmethane dyes, thiazine dyes such as methylene blue and thionin, anthraquinonoid dyes such as alizarin, acridine dyes, and styryl dyes. Specific examples of such sensitizers are disclosed in said Yamada et al patent.

The currently preferred embodiments are those in which the photoinhibitor comprises a compound or composition free of accompanying spectral sensitizers. Although highly useful examples of such photoinhibitors are photolytic acid generators, it is not known whether all photolytic acid generators will function as such photoinhibitors. In fact, o-nitrobenzaldehyde is a known photolytic acid generator which is not useful, as its photoproduct appears to complex with cobalt, and is therefore incompatible in the composition of the invention. Therefore, only compatible photolytic acid generators capable of inhibiting the release of amines arising from the exposure of the image precursor composition, are contemplated for use in this invention. "Compatible acid generators" are those which do not interfere with the desired reaction of the invention.

With respect to compatible, useful photolytic acid generators, the theoretical mechanism by which the acid is generated is not fully understood. That is, it is not clear whether a free radical which abstracts a proton from the rest of the composition to form an acid which neutralizes released amines, forms in response to the radiation, or whether the generator decomposes directly into acids. Nor is it clear that the acids, whenever and however formed, serve to neutralize released amines, or whether instead they directly inhibit the cobalt(III) complex from releasing amines in the first place. However, the understanding of the mechanism is not necessary to the practice of the invention.

Any photoinhibitor compound or composition having the desired property of inhibiting the release of amines in response to an exposure, can be utilized. Where the mixture of image precursor composition and photoinhibitor is intended to be used as a dry coating composition, it is preferable that the photoinhibitor composition be capable of being coated without extensive volatilization. Where a photoinhibitor is to be used with a photoreductant, each of the two photoresponsive compounds are selected so that their $\lambda_{max}$ absorption wavelengths do not coincide, and preferably are at least about 50 nm apart.

Useful examples of photoinhibitor compounds, all of which are compatible photolytic acid generators having an inherent sensitivity that responds to a radiation of a wavelength longer than about 300 nm., including the following materials as well as equivalents thereof:

(a) heterocyclic compounds containing at least one trihalogenated alkyl group, preferably those with a chromophore substituent, such chromophores being any unsaturated substituent which imparts color to the compound, for example, those disclosed in U.S. Pat. No. 3,987,037, or mixtures of such heterocyclic compounds;

(b) N-o-nitrophenylamides;

(c) anthranilium salts such as those having the structure:

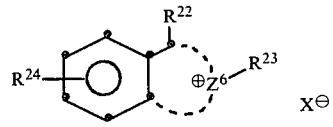

wherein $R^{22}$ is phenyl, alkyl containing from 1 to about 4 carbon atoms, such as methyl, ethyl, isopropyl and the like, or hydrogen; $R^{23}$ is alkyl containing from 1 to about 4 carbon atoms, such as methyl, ethyl, isopropyl and the like, or 1-adamantyl; $R^{24}$ is hydrogen or a halide such as chloride, bromide or the like; $Z^6$ is either $$=N^{\oplus}-O-,\ =N^{\oplus}-S-,\ \text{or}\ =N^{\oplus}-\underset{\underset{R^{11}}{|}}{N}-;$$

$R^{11}$ is as defined above; and $X^{\ominus}$ is a suitable anion. Useful examples include N-methyl-3-phenyl-2,1-benzisoxazolium perchlorate and N-methyl-3-phenyl-2,1-benzisoxazolium fluorosulfonate; and (d) other halogenated organic compounds such as iodoform and the like.

With respect to class (a) photoinhibitors, preferred are those having the formula:

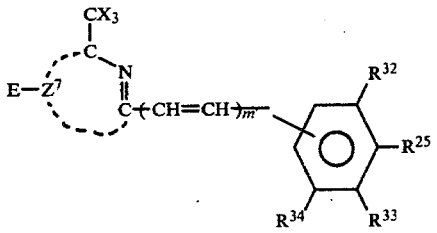

wherein:

E is hydrogen, $CH_3$ or $CX_3$;

$R^{25}$ is hydrogen, halide, such as chloride, fluoride and the like, nitro or alkyl, dialkylamino, or alkoxy containing from 1 to 5 carbon atoms in the alkyl portion such as methyl, ethyl, isopropyl and the like;

$R^{32}$ is hydrogen or alkoxy containing from 1 to 5 carbon atoms, such as methoxy, ethoxy and the like;

$R^{33}$ is hydrogen, alkoxy containing from 1 to 5 carbon atoms, or together with $R^{34}$ comprises the necessary nonmetallic atoms to complete an aromatic ring;

$R^{34}$ is hydrogen, or together with $R^{33}$ comprises the necessary nonmetallic atoms to complete an aromatic ring;

$Z^7$ is the nonmetallic atoms necessary to complete one or more aromatic rings containing from 6 to 10 ring atoms, such as S-triazine, quinoline, quinoxaline, pyrazine, pyrimidine, and the like, $Z^7$ being substituted or unsubstituted;

m' is 0, 1 or 2;

and X is a halide, such as chloride, bromide, and the like. Particularly useful examples are mixtures of S-triazines having the formula:

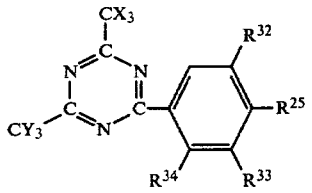

wherein X, $R^{25}$, $R^{32}$, $R^{33}$, and $R^{34}$ are as defined above, and Y is the same as or different from X and is selected from the group consisting of halogen and hydrogen, at least one of X and Y being halogen.

With respect to class (b) photoinhibitors, highly preferred are those having the formula:

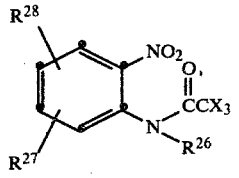

wherein:

$R^{26}$, taken alone, is alkyl containing from 1 to about 3 carbon atoms, or aralkyl containing from about 7 to 8 carbon atoms, such as benzyl, phenethyl and the like, or $R^{26}$, taken together with $R^{27}$, forms a fused heterocyclic ring such as benzoindole and the like;

$R^{27}$ is halide, such as chloride, bromide and the like, or together with $R^{26}$ it forms a fused heterocyclic ring;

$R^{28}$ is hydrogen or alkoxy containing from 1 to about 3 carbon atoms, such as methoxy, ethoxy and the like;

and X is halide such as fluoride, chloride, bromide and the like.

The following Table III is a partial listing of useful photoinhibitors of the invention:

TABLE III -- Photoinhibitors

PI 1—iodoform
PI 2—2,4-bis(trichloromethyl)-6-(p-anisyl)-S-triazine
PI 3—2,4-bis(trichloromethyl)-6-(p-methoxy styryl)-S-triazine
PI 4—2,4-bis(trichloromethyl)-6-(1-naphthyl)-S-triazine
PI 5—2,4-bis(trichloromethyl)-6-(4-methoxy-1-naphthyl)-S-triazine
PI 6—2,4-bis(trichloromethyl)-6-[p-(dimethylamino phenylene)-1,3-butadienyl]-S-triazine
PI 7—2-tribromomethylquinoline
PI 8—2-tribromomethylquinoxaline
PI 9—2-tribromomethyl-4-oxo-4H-1-benzopyran
PI 10—N-methyl-o-nitrotrifluoroacetanilide
PI 11—N-benzyl-o-nitrotrifluoroacetanilide

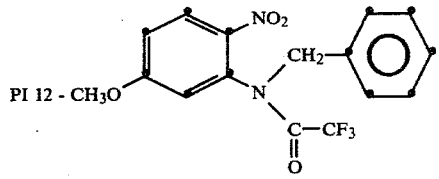

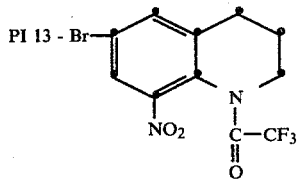

PI 14—N-methyl-3-diazo-4-oxoquinolinium-p-toluenesulfonate
PI 15—2,4-bis(trichloromethyl)-6-[p-(dimethylamino)-styryl]-S-triazine
PI 16—N-methyl-3-phenyl-2,1-benzisoxazolium perchlorate
PI 17—N-methyl-3-phenyl-2,1-benzisoxazolium fluorosulfonate.
PI 18—carbon tetrabromide PI 19—β-tribromoethanol
PI 20—hexabromoethane
PI 21—ethyl tribromoacetate
PI 22—tribromoacetamide
PI 23—tribromomethylbenzene
PI 24—pentabromoethane
PI 25—α,α,α-tribromoacetophenone
PI 26—3-nitro-α,α,α-tribromoacetophenone
Pi 27—2,3-bis(tribromomethyl)quinoxaline.

The currently preferred photoinhibitor is a mixture of PI 2 and PI 5, a mixture of PI 2 and PI 4, or PI 4 alone.

Elements

An imaging element can be prepared by coating or otherwise forming a layer of the afore-described composition from solution. The simplest form of the invention comprises a support and in a single layer on the support, an image precursor composition and a photoinhibitor composition provided in accordance with the invention. Alternatively, the image precursor composition and photoinhibitor composition can be divided into a plurality of layers. Such plurality of layers can still form an integral element, or alternatively the outermost layer can be disposed in reactable association subsequently, such as after exposure of the photoinhibitor composition. For example, the image-forming material can be included either as an integral portion of the element of the invention, or it can be subsequently associated therewith as a separate image-recording layer. In those embodiments wherein the image-forming material is an integral part of the element, it can either be admixed with the cobalt(III) complex, preferably as a dye-forming material, or it can be in a separate, adjacent layer. In those embodiments wherein it is admixed with the cobalt(III) complex, highly preferred embodiments are those in which the image-forming material is also an amplifier, such as phthalaldehyde, resulting from its function as a reducing agent precursor.

Yet another alternative is to imbibe the photoinhibitor composition into the image precursor composition, such as by spraying or otherwise applying a solution of the photoinhibitor composition to the element already containing the precursor composition.

Preferably the image precursor composition and photoinhibitor composition are coated onto a support, particularly where the coating is not self supporting. Any conventional photographic support can be used in the practice of this invention. Typical supports include transparent supports, such as film supports and glass supports, as well as opaque supports, such as metal and photographic paper supports. The support can be either rigid or flexible. The most common photographic supports for most applications are paper, including those with matte finishes, and transparent film supports, such as poly(ethylene terephthalate) film. Suitable exemplary supports are disclosed in *Product Licensing Index,* Volume 92, December 1971, Publication No. 9232, at page 108, and *Research Disclosure,* Volume 134, June 1975, Publication No. 13455, published by Industrial Opportunities Limited, Homewell, Havant Hampshire PO9-1EF, United Kingdom. The support can incorporate one or more subbing layers for the purpose of altering its surface properties so as to enhance the adhesion of the radiation-sensitive coating to the support.

When coating the support, a binder can be included in the solution composition, depending on the support used, if any. For example, paper supports do not require a binder. If required, any binder compatible with cobalt(III) complexes can be used, for example, the binders listed in the aforesaid Publication No. 12617 of Research Disclosure, especially paragraph I(D), the details of which are expressly incorporated herein by reference. Typical of such binders are acetates, cellulose compounds, vinyl polymers, polyacrylates and polyesters. In addition in those embodiments relying upon phthalaldehyde as the dye-forming material and/or as an amplifier, it is preferred that the binder be selected which will maximize the maximum neutral densities produced during exposure and development. Highly preferred examples of such binders include certain polysulfonamides, for example, poly(ethylene-co-1,4-cyclohexylenedimethylene-1-methyl-2,4-benzenedisulfonamide) and poly(ethylene-co-hexamethylene-1-methyl-2,4-benzenedisulfonamide), and poly(methacrylonitrile).

The coating solvent selected will, of course, depend upon the makeup of the composition, including the binder if any. Typical preferred solvents which can be used alone or in combination are lower alkanols, such as methanol, ethanol, isopropanol, t-butanol and the like; ketones, such as methylethyl ketone, acetone and the like; water; ethers, such as tetrahydrofuran, and the like; acetonitrile; dimethyl sulfoxide and dimethylformamide. The chlorinated hydrocarbon solvents are not effective as acid generators, as they volatize out of the coating.

The proportions of the non-binder reactants forming the composition to be coated and/or the imaging element can vary widely, depending upon which materials are being used. Since in any event, cobalt(III) complex is present, the molar amounts are expressed per mole of complex. Thus, if destabilizer materials are incorporated in addition to cobalt(III) complex, they can vary widely from about 0.004 moles per mole of complex, such as for ferrocene, to about 5 moles of other destabilizers per mole of complex. For example, 5-n-butylbarbituric acid can be present in an amount of between about 0.005 moles and about 5 moles per mole of the complex. With respect to the photoinhibitor, it can be present in an amount from between about 0.005 to about 2.5 moles per mole of cobalt(III) complex. For example, 2,4-bis(trichloromethyl)-6-(b-anisyl)-S-triazine can be present in those amounts.

A convenient range of coating coverage of cobalt(III) complex is between about 5 and about 50 mg/dm$^2$.

Typically, solutions are coated onto the support by such means as whirler coating, brushing, doctor-blade coating, hopper coating and the like. Thereafter, the solvent is evaporated. Other exemplary coating procedures are set forth in the *Product Licensing Index,* Volume 92, December 1971, Publication No. 9232, at page 109, published by Industrial Opportunities Limited, Homewell, Havant Hampshire PO91EF, United Kingdom. Addenda such as coating aids and plasticizers can be incorporated into the coating composition.

In certain instances, an overcoat for the radiationsensitive layer of the element can supply improved handling characteristics, and can help to retain otherwise volatile components. Useful examples include gelatin overcoats crosslinked with an agent, such as a 5 weight percent aqueous solution of hexamethoxymethyl melamine, and polymers having the recurring units:

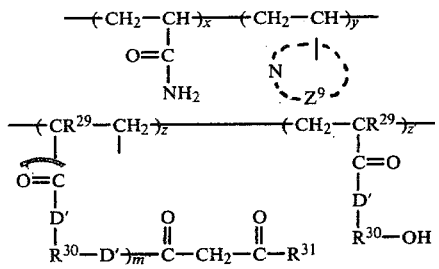

wherein:

$R^{30}$ is alkylene containing 1 to 3 carbon atoms and $R^{31}$ is alkyl containing 1 to 3 carbon atoms;

$R^{29}$ is H or the same as $R^{31}$;

m'' is 1 or 0;

$Z^9$ is from 3 to 8 atoms necessary to complete one or more saturated or unsaturated heterocyclic rings;

D' is —NH— or —O—; and x, y, z and z' are weight percents of the recurring units of the polymer and $25 \leqq x \leqq 90$ $10 \leqq y \leqq 75$ $0 \leqq z \leqq 10$ $0 \leqq z' \leqq 10$.

The currently preferred form of the overcoat is a dual coating first of gelatin crosslinked as noted, and as a final coat, a layer of cellulose acetate having an acetyl content of 19 weight percent and an ash content of 0.04 weight percent.

Figure 1B:
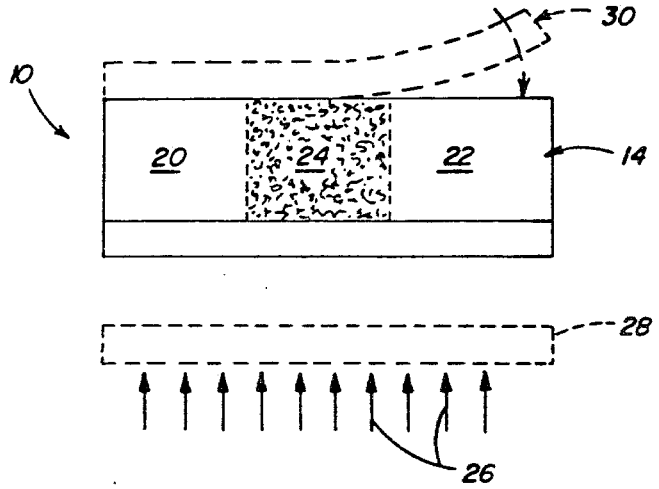

Further details of the imaging element, and the process of use, can be understood by reference to the drawings. In FIG. 1*a*, element 10 comprises a support 12 and a layer 14 containing, in admixture, an image precursor composition designated by wavy lines, a photoinhibitor composition, and imageforming material here assumed to be a dye-forming material. The element is imagewise exposed to activating radiation, preferably light, designated by arrows 16, through an image 18. As shown in FIG. 1*b*, the radiation activates the photoinhibitor in portions 20 and 22 to inhibit the image precursor composition, as suggested by the absence of wavy lines, but not in the unexposed portion 24. In many cases this is true even if the image precursor composition in layer 14 includes, together with the cobalt(III) complex, one of the photoreductants noted above, as the effect of many of the photoinhibitors is more rapid than is the production of amines by the activation of the photoreductant. However, in some instances it may be desirable to interpose an optional filter 25, shown in phantom in FIG. 1A, which is effective to prevent transmission of radiation such as would activate the photoreductant, but which transmits radiation 16 effective for the activation of the photoinhibitor. For example, if the photoinhibitor is iodoform and the image precursor composition includes quinone photoreductants, a "Wratten 18A"® filter, manufactured by Eastman Kodak Company, can be used.

Thereafter, as shown in FIG. 1*b*, an overall exposure is given to the entire element 10, as indicated by arrows 26, and this may be either a thermal exposure or a light exposure. If it is a light exposure, the image precursor composition preferably includes a photoreductant and it is necessary that the photoinhibitor be prevented from responding in portion 24. A preferred method for accomplishing this is the interposition of a suitable filter 28, shown in phantom in FIG. 1*b*. Such a filter is selected to cut off the wavelengths which are necessary for the photoactivation of the photoinhibitor, and to transmit the wavelengths, usually longer, useful in activating the photoreductant. For example, if the photoinhibitor is iodoform and the image precursor composition includes a quinone photoreductant, a "Wratten 2A" filter can be used.

Figure 1C:
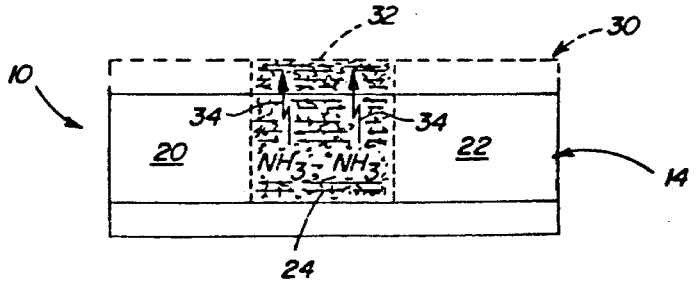

The effect of the exposure of the image precursor composition is to generate a dye in portion 24, FIG. 1*c*, and none in portions 20 and 22, thus rendering element 10 positive-working. The dye is schematically shown by the superimposed straight lines. Alternatively, released ammonia can migrate to portion 32 of optional layer 30, which if comprised of a diazo salt and coupler forms an azo dye.

For example, the presently preferred embodiment features phthalaldehyde (PA) as an amplifier and dye-forming material incorporated in layer 14, along with an S-triazine photoinhibitor such as 2,4-bis(trichloromethyl)-6-(p-anisyl)-S-triazine, hexa-ammine cobalt(III) trifluoroacetate complex and either 5-n-butylbarbituric acid or 5,5-diphenylhydantoin destabilize material. Imagewise exposure to light activates the photoinhibitor. A subsequent overall thermal exposure, such as at 150° C. for the barbituric acid and 130° C. for the hydantoin, causes reduction of the complex, release of ammonia, formation of the adduct of PA, further reduction of remaining cobalt(III) complex, release of more ammonia, and amplified dye formation.

Alternatively, the image-forming material of the image precursor composition, which can be, for example, phthalaldehyde as noted above, can be disposed in an adjacent layer 30, shown in phantom in FIGS. 1*b* and *c*. As shown, layer 30 is positioned in contact as an overlay for element 10 after the imagewise exposure of FIG. 1*a*, but alternatively it can be overcoated onto layer 14 as an integral portion of element 10. In either case the exposure of the image precursor composition, arrows 26, will develop the release of ligands in portion 24 only, with or without dye formation, and the ligands, shown here to be $NH_3$, will migrate to portion 32 of the layer 30 as shown by arrows 34, where either a dye is formed or a preincorporated dye is bleached or altered in color. Thereafter, layer 30 can be removed from, or retained on, element 10.

In FIG. 2*a*, the same element as in FIG. 1*a* (without any optional overlayer 30) is given a different treatment to render it negative-working. Specifically, the same identical element, regardless of the image precursor composition used, is rendered negative-working merely by changing the exposure sequence. That is, the process step effectuated by imagewise exposure is now an exposure capable of activating the image precursor composition rather than the photoinhibitor. Parts similar to those previously described bear the same reference numeral to which the distinguishing suffix "a" is added. For purposes of comparing this negative-working mode to the positive-working mode previously discussed, it is again assumed that the image-forming material of the image precursor composition is a dye-forming material. Thus, element 10*a* comprises the same coating 14*a* on support 12*a* as described before. However, imagewise exposure (arrows 16*a*) through image 18*a* must not activate the photoinhibitor. If exposure 16*a* is thermal, only the image precursor composition is activated. In such instances image 18*a* is selected so as not to significantly re-radiate in the "dark" areas. If, however, exposure 16a is broadband light radiation, it preferably passes through a suitable filter 28a, shown in phantom, selected to prevent transmission of radiation sufficient to activate the photoinhibitor, but to allow transmission of radiation sufficient to activate the image precursor composition. As noted before, a "Wratten 2A" filter is effective if the photoinhibitor is iodoform and the image precursor composition includes a quinone photoreductant. In the case of a photoreductant destabilizer material, an optional subsequent thermal exposure can be included. Dye then imagewise develops in areas 20a and 22a, FIG. 2b.

An overall exposure is provided, arrows 26a of FIG. 2b as an inhibiting exposure sufficient to activate the photoinhibitor in portion 24a of layer 14a, to inhibit the image precursor composition chemistry of portion 24a, thus preventing background print-up. As in the case of the imagewise exposure step of FIG. 1a, it may be desirable in some instances to interpose a suitable filter 25a, shown in phantom, to insure that the exposure 26a does not activate the image precursor composition.

As in the case of the process shown in FIGS. 1b and 1c, the negative image can be formed instead in an adjacent layer, not shown, by transfer of ligands thereto from layer 14a.

If the photinhibitor composition includes a compound having a response only to radiation of wavelengths shorter than about 300 nm. and a spectral sensitizer, as described above, it is contemplated that the composition and/or element of the invention is one in which the photoinhibitor composition and the image precursor composition each occupy two separate but adjacent layers 40 and 50, element 10b of FIG. 3. In this manner, the spectral sensitizer will sensitize only the photoinhibitor compound and not also the cobalt(III) complex or the destabilizer material, so that photoinitiation of the inhibitor will not also act to activate the image precursor composition. If the photoinhibitor does not inherently produce a volatile acid capable of being readily transferred to the layer containing the image precursor composition, for the inhibition step, the photoinhibitor layer can optionally include sodium trifluroacetate, to produce in the presence of the nonvolatile acid generated by the photoinhibitor, trifluoroacetic acid which is sufficiently volatile.

EXAMPLES 1-3—USE OF ORGANO-METALLIC DESTABILIZER MATERIALS

A solution was prepared by adding 265 mg of hexaamminecobalt (III) trifluoroacetate, hereinafter Cohex TFA, 535 mg of phthalaldehyde, and 30 mg of 2,4-bis(-trichloromethyl)-6-p-methoxystyryl-S-triazine in 2 g of acetone. To this solution were added 10 g of a 20% solution of poly(ethylene-cohexamethylene-1-methyl-2,4-benzenedisulfonamide) in 1:1 acetone/methylethylketone to make stock solution A.

Solution B was prepared by dissolving 4 mg of ferrocene (dicyclopentadienyl iron) in 6 g of acetone. Solution C was prepared by dissolving 4 mg of 1,1-dimethylferrocene in 6 g of acetone. Solution D was prepared by dissolving 10 mg of N,N-dimethylaniline chromium tricarbonyl in 6 g of acetone.

To 1.9 g of stock solution A was added 0.1 g of solution B to form the coating solution for Example 1. This solution was then coated with a 100-micron blade on a subbed poly(ethylene terephthalate) support, dried, and overcoated with a 5% aqueous solution of poly(acrylamido-co-N-vinyl-2-pyrrolidinone-co-2-acetoacetoxyethylmethacrylate, hereinafter APyMt, using a 50-micron doctor blade, and dried. After drying, the film was exposed through a silver master for about 8 seconds in an IBM Microcopier IID exposing apparatus and dye-developed by heating, face up, for five seconds on a 160° C. hot block. A high density, positive image resulted. Similar results were obtained when solutions C and D were substituted for solution B to make the coating solutions for Examples 2 and 3.

EXAMPLE 4—4-PHENYL CATECHOL AS A DESTABILIZER MATERIAL WITHOUT PHTHALALDEHYDE 20 mg of $(NH_3)_6Co(CF_3CO_2)_3$, 7 mg of 4-phenyl catechol and 16 mg of iodoform were dissolved in 700 mg of acetone. 1.4 g of a 15 percent solution of cellulose acetate butyrate in acetone were added and the resulting solution was coated with a 4-mil doctor blade on a subbed poly(ethylene terephthalate) support. This film was exposed for 8 seconds through a 0.3 log E silver step tablet in a copying apparatus containing a 400-watt medium pressure mercury arc lamp (commercially available as a Micro Master Diazo Copier). The exposed film was placed in face-to-face contact with a diazo-coupler recording element (commercially available from Eastman Kodak Company under the trade name Kodak Diazo Type M) and the sandwich was passed twice through a set of rollers heated to 140° C. at a speed of 12.7 cm per minute. A positive bluish image of the step tablet was produced with minimum densities of 0.07 and maximum densities of 0.5, when read using red light.

EXAMPLES 5-6—USE OF SULFONAMIDOPHENOLS AND NAPHTHOLS AS DESTABILIZER MATERIALS

The following composition was prepared:

| | |
|---|---|
| Acetone | 81.5 g |
| Poly(ethylene-co-1,4-cyclohexylenedimethylene-1-methyl-2,4-benzenedisulfonamide | 11.1 g |
| N,N-bis(2-hydroxyethyl)dodecanamide | 0.748 g |
| Cohex TFA | 1.73 g |
| 2,4-bis(trichloromethyl)-6-(p-methoxystyryl)-S-triazine | 0.0196 g |
| 2,4-bis(trichloromethyl)-6-(p-anisyl)-S-triazine | 0.288 g |
| Phthalaldehyde | 3.46 g |
| "SF-1066" Surfactant, a dimethyl polyoxyalkylene ether copolymer supplied by General Electric Company | 0.92 g |

To respective 4.0 g portions of the above dope were added 12.0 mg of the following sulfonamidophenols:

EXAMPLE 5

4-phenylsulfonamido-2,6-dichlorophenol

EXAMPLE 6

4-phenylsulfonamido-2-methyl-l-naphthol

The resulting solutions were then coated with a 150-micron doctor blade on subbed poly(ethylene terephthalate) support, dried and then overcoated with a 4.7% aqueous solution of APyMt polymer (50:45:5 by weight) containing 0.05% Surfactant 10G, a nonylphenoxypolyglycerol coating acid, with a 50-micron doctor blade.

Samples of the dried coatings were then exposed for about two seconds through a 0.15 log E step tablet in an IBM Microcopier IID exposing apparatus. Processing for a 7.3 second contact time in a 150°–155° C. Canon Kalfile processor resulted in positive images for each coating.

Further coating samples were similarly exposed and dye-developed for ten seconds, face up, on a hot block. The neutral D-max obtained as a function of process temperature follows:

| Example | Temperature | D-min | D-max |
|---|---|---|---|
| 5 | 145° C. | 0.03 | 0.04 |
| 5 | 150° C. | 0.03 | 0.08 |
| 5 | 155° C. | 0.04 | 0.15 |
| 5 | 160° C. | 0.04 | 0.60 |
| 5 | 165° C. | 0.04 | 0.72 |
| 5 | 170° C. | 0.08 | 2.10 |
| 6 | 145° C. | 0.08 | 2.79 |
| 6 | 150° C. | 0.08 | 3.14 |
| 6 | 155° C. | 0.08 | 3.19 |
| 6 | 160° C. | 0.23 | 3.21 |
| 6 | 165° C. | 0.31 | 3.28 |
| 6 | 170° C. | 0.66 | 3.37 |

EXAMPLE 7 —OTHER NAPHTHOL DESTABILIZER MATERIALS

A stock solution was prepared by dissolving 200 mg of Cohex TFA, 400 mg of phthalaldehyde, and 20 mg of 2,4-bis(trichloromethyl)-6-p-methoxystyryl-S-triazine in 2 g of acetone. To this solution were added 8 g of a 20% solution of poly(ethylene-co-hexamethylene-1-methyl-2,4-benzenedisulfonamide) in acetone.

In 2g of the stock solution was dissolved 1 mg of 4-methoxynaphthol. This solution was coated with a 4-mil doctor blade on subbed poly(ethylene terephthalate) support, dried, and then overcoated with a 5% aqueous solution of APyMT polymer using a 50 micron doctor blade. After drying, the film was exposed and dye-developed in the manner described in Example 1, to give a neutral positive image with D-max=2.7 and D-min=0.08.

EXAMPLE 8 — A PYRAZOLIDONE AS A DESTABILIZER MATERIAL

The following composition was prepared:

| | |
|---|---|
| Acetone | 15.97 g |
| Poly(ethylene-co-1,4-cyclohexylenedimethylene-1-methyl-2,4-benzenedisulfonamide) | 77.6 g |
| N,N-bis(2-hydroxyethyl)dodecanamide | 0.65 g |
| Cohex TFA | 1.73 g |
| 2,4-bis(trichloromethyl-6-(p-methoxystyryl)-S-triazine | 0.017 g |
| 2,4-bis(trichloromethyl)-6-(p-anisyl)-S-triazine | 0.25 g |
| Phthalaldehyde | 3.01 g |
| GE SF-1066 Surfactant | 0.80 g |

To 3.8 g of this dope was added, 6.5 mg of 4-hydroxymethyl-4-methyl-1-phenyl-3-pyrazolidone.

The resulting solution was then coated with a 150-micron doctor blade on a subbed poly(ethylene terephthalate) support, and dried. The coating was overcoated with a 5% aqueous solution of APyMt polymer (50:45:5 by weight) containing 0.05% Surfactant 10G with a 50-micron doctor blade.

A sample of the two dried coatings was then exposed for about 16 seconds through a 0.15 log E step tablet in an IBM Microcopier IID exposing apparatus and processed for a 5.5-second contact time in a 150° C. Canon Kalfile processor. A positive image with neutral D-max of about 2.73 and a brownish D-min of 0.21 was obtained.

EXAMPLE 9 — ANOTHER PYRAZOLIDONE DESTABILIZER

A stock solution was prepared by dissolving 20 mg of Cohex TFA, 400 mg of phthalaldehyde, and 200 mg of 2,4-bis(trichloromethyl)-6-p-methoxystyryl-S-triazine in 2 g of acetone. To this solution were added 8 g of a 20% solution of poly(ethylene-co-hexamethylene-1-methyl-2,4-benzenedisulfonamide) in acetone.

In 2 g of the stock solution was dissolved 1 mg of 4,4-dimethyl-1-phenyl-3-pyrazolidone. This solution was coated with a 4-mil doctor blade on subbed poly(ethylene terephthalate) support, dried, and then overcoated with a 5% aqueous solution of APyMt polymer using a 50-micron doctor blade. After drying again, the film was exposed through a silver master for about 8 seconds in an IBM Microcopier IID exposing apparatus and heat-processed, face up, for five seconds on a 160° C. hot block to give a neutral positive image with D-max=3.0 and D-min=0.05.

EXAMPLES 10–11 — ACIDS AS A DESTABILIZER MATERIAL

A master dope was prepared for Example 10 comprising 400 mg of Cohex TFA, 800 mg of phthalaldehyde, 200 mg of N,N-bis(2-hydroxyethyl) dodecanamide, and 40 mg of 2,4-bis(trichloromethyl)-6-p-methoxystyryl-s-triazine in 20 gms of 20% poly(ethylene-co-1,4-cyclohexylenedimethylene-1-methyl-2,4-benzenedisulfonamide in acetone.

To two grams of this master dope were added 4 mg of phthalamic acid, and the dope was then coated on subbed poly(ethylene terephthalate) with a 100-micron coating knife. A 50-micron overcoat of APyMt (5% in water) was then applied after drying. The resulting film was exposed for 8 seconds in an IBM Micromaster IID exposing device through a 0.3 log E step tablet and heated for 5 seconds, face up, on a 160° C. hot block. A positive neutral image with a D-max/D-min of 2.0/0.06 was produced.

Example 11 was a repeat of Example 10 except that 4 mg of 2-carboxycyclohexycarboxamide was used in place of phthalamic acid. A positive image was produced of D-max/D-min=2.1/0.06.

EXAMPLES 12–13—UREAS AS A DESTABILIZER MATERIAL

A stock solution was prepared by dissolving 266 mg of Cohex TFA and 534 mg phthalaldehyde in 2 g of acetone and adding to this 10 g of a 20% solution of poly(ethylene-co-1,4-cyclohexylenedimethylene-1-methyl-2,4-benzenedisulfonamide) in acetone.

In 2 g of the stock solution were dissolved 8 mg of iodoform and 5 mg of 1-(2-hydroxyphenyl)urea. This solution was coated with a 100-micron doctor blade and overcoated with a 5% aqueous solution of APyMt using a 50-micron doctor blade. The film was exposed through a silver master for 8 seconds on a Micromaster IID Copier and dye-developed by heating, face up, for 5 seconds on a 160° C. hot block to produce a neutral positive image with a density of 2.8.

To illustrate the use of a different photoinhibitor, Example 13 comprised a repetition of Example 12 under red light conditions except that iodoform was replaced with 1 mg of

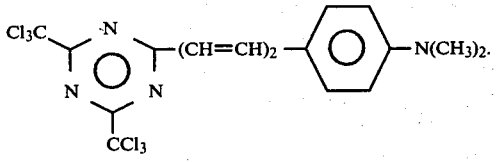

The film was exposed through a silver master for 7 seconds to a 650-watt incandescent source (commercially available under the trade name Nashua 120 Multi-Spectrum Copier). When dye-developed by heat-processing as in Example 10, a neutral positive image with a density of 2.3 was produced.

EXAMPLES 14–16—SALTS AS DESTABILIZER MATERIALS

For Example 14, in 3.8 g of a 13.6% solution of poly(ethylene-co-1,4-cyclohexylenedimethylene-1-methyl-2,4-benzenedisulfonamide) in acetone were dissolved 66.4 mg of Cohex TFA, 120 mg of o-phthalaldehyde, 9.9 mg of 2,4-bis(trichloromethyl)-6-(p-anisyl)-s-triazine, 26 mg of N, N-bis(2-hydroxyethyl) dodecanamide, and 12 mg of SF-1066 surfactant (from General Electric). To this dope was added 9.6 mg of 1-(β-aminoethyl)-2-imidazolidinone trichloroacetate and the resulting solution was coated with a 150-micron doctor blade on subbed poly(ethylene terephthalate) support. This coating was then overcoated with a 4.5% solution of APyMt (50:45:5) in water with 0.06% 10 G surfactant coating aid using a 50-micron doctor blade.

The dried coating was exposed for 2 seconds through a 0.15 log E step tablet using a Micro Master Diazo Copier and dye-developed by heating, face up, in a 150° C. Canon Kalfile processor for 5.5 seconds. A brownish positive image having a D-max of 0.98 with a D-min of 0.17 to blue light was obtained.

It is believed that the precursor salt underwent the following thermal decomposition to generate an amine:

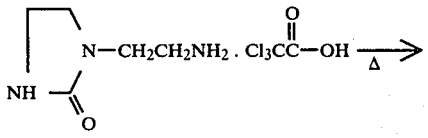

-continued

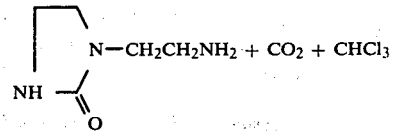

In Example 15, Example 14 was repeated except that the destabilizer material comprised 2-amino-2-thiazoline trichloroacetate. Example 16 was a repetition of Example 14 except the destabilizer material was anilinium trichloroacetate. Both of these produced a satisfactory positive image.

EXAMPLE 17—USE OF A MORPHOLINE PRECURSOR DESTABILIZER MATERIAL

In 78 g of acetone were dissolved 15.9 g of poly(ethylene-co-1,4-cyclohexylenedimethylene-1-methyl-2,4-benzenedisulfonamide), 650 mg of N, N-bis(2-hydroxyethyl) dodecanamide, 1.66 g of Cohex TFA, 17 mg of 2,4-bis-(trichloromethyl)-6-(p-methoxystyryl)-s-triazine, 250 mg of 2,4-bis(trichloromethyl)-6-(p-anisyl)-s-triazine, 3.0 g of o-phthalaldehyde, and 800 mg of SF-1066 surfactant (General Electric). To 3.8 g of this dope were added 3.2 mg of 3,3-bis(morphilino)oxindole. The resulting solution was coated with a 150-micron doctor blade on subbed poly(ethylene terephthalate) support, dried, and subsequently overcoated with a 4.5% solution of APyMt (50:45:5) in water with 0.05% 10 G surfactant coating aid using a 50-micron doctor blade.

The dried coating was exposed for 8 seconds through a 0.15 log E silver step tablet using the Micro Master Diazo Copier and dye developed by heating, face up, on a 150° hot block. A neutral positive image having a D-max of 2.56 and D-min of 0.06 was obtained.

EXAMPLES 18–27—AMINIMIDES AS DESTABILIZER MATERIALS

A light-sensitive composition was prepared as follows:

| | |
|---|---|
| 12.9 g | Poly(ethylene-co-1,4-cyclohexylene-dimethylene-1-methyl-2,4-benzene-disulfonamide |
| 81.6 g | Acetone |
| 0.30 g | General Electric SF-1066 Surfactant |
| 0.65 g | Recrystallized N,N-bis(2-hydroxyethyl)-dodecanamide |
| 3.01 g | o-phthalaldehyde |
| 0.25 g | 2,4-bis(trichloromethyl)-6-p-anisyl-S-triazine |
| 0.017 g | 2,4-bis(trichloromethyl)-6-[p-methoxy-styryl]-S-triazine |
| 1.66 g | Cohex TFA |

To 10.0 g of the preceding was added the aminimides of Table III. A separate control was prepared by using 5,5-diphenylhydantoin in place of the aminimide.

TABLE III

Aminimides

| Example | Aminimide | Amount (mg) |
|---|---|---|
| Control | — | 20.8 |
| 18 | (trimethylamine)cinnamimide | 16.8 |
| 19 | bis(dimethyl-2-hydroxypropylamine) adipimide | 14.3 |

TABLE III-continued

| Example | Aminimides: Aminimide | Amount (mg) |
|---|---|---|
| 20 | 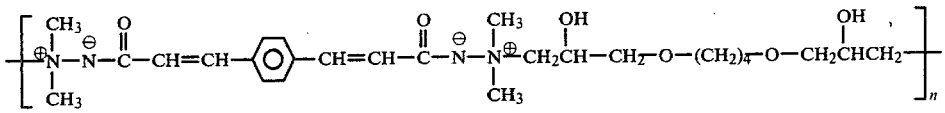 | 19.3 |
| 21 | (Dimethyl-2-hydroxypropylamine)palmitimide | 29.3 |
| 22 | (Dimethyl-2-hydroxypropylamine)laurimide | 24.8 |
| 23 | (Dimethyl-2-hydroxypropylamine)myristimide | 27.0 |
| 24 | bis(trimethylamine)sebacimide | 13.0 |
| 25 | poly[1,1-dimethyl-1-(2-hydroxypropyl)amine methacrylimide] | 15.3 |
| 26 | poly(trimethylamine methacrylimide) | 11.8 |
| 27 | bis(trimethylamine)azelaimide | 13.8 |

After mixing the resulting solutions, handcoatings were made utilizing a 150-micron wet laydown upon a transparent, subbed, poly(ethylene terephthalate) support. The coatings were appropriately dried and then overcoated with a 50-micron wet laydown of 4.5% aqueous APyMt containing 0.6% 10 G surfactant and redried. Coating samples were sensitometrically exposed in an IBM Microcopier II exposing unit. The destabilizer exposure was conducted for 5 to 10 seconds in a 150° C. Canon Kalfile processor. All samples and the control turned black in the non-image areas and remained clear in the exposed areas, and thus were positive-working. Example 18 was 1.2 log E slower and 0.3 higher in neutral D-max than the control which exhibited a D-max of 2.6.

It was further found that Example 18 gave a substantial improvement in processing, or development, latitude.

EXAMPLES 28–31—USE OF TRIAZOLE DESTABILIZER MATERIALS

In 81.5 g of acetone were dissolved 11.1 g of poly(ethylene-co-1,4-cyclohexylenedimethylene-1-methyl-2,4-benzenedisulfonamide), 748 mg of N,N-bis(2-hydroxyethyl) dodecanamide, 1.73 g of Cohex TFA, 19.6 mg of 2,4-bis(trichloromethyl)-6-(p-methoxystyryl)-s-triazine, 288 mg of 2,4-bis(trichloromethyl)-6-(p-anisyl)-s-triazine, 3.46 g of o-phthalaldehyde and 920 mg of SF-1066 surfactant (obtained from General Electric). To 4.0 g of this dope were added 9.5 mg of 5-methyl-1(2)-N-(phenylcarbamoyl) benzotriazole, for Example 28 (structure depicted below),

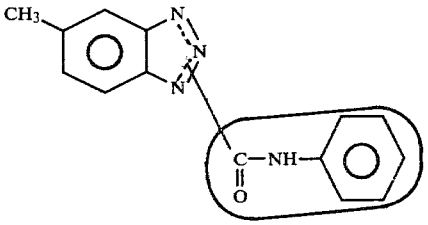

the circled portion being a thermally releasable blocking group.

The resulting solution was coated with a 150-micron doctor blade on a subbed poly(ethylene terephthalate) support, dried and then overcoated with a 4.7% solution of APyMt (50:45:5) in water containing 0.05% 10 G surfactant coating aid, using a 50-micron doctor blade.

The dried coating was then exposed for 2 seconds through a 0.15 log E silver step tablet using a Micro Master Diazo Copier and dye-developed by heating, face up, on a 160° C. hot block. A brownish, positive image having a D-max of 1.30 and D-min of 0.58 to blue light was obtained.

Examples 29–31 were the same as Example 28, with approximately the same results, except that the destabilizer materials were:

Example 29

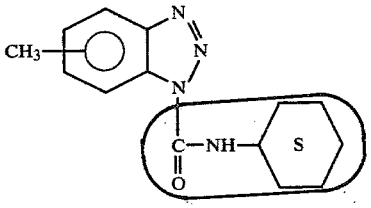

Example 30

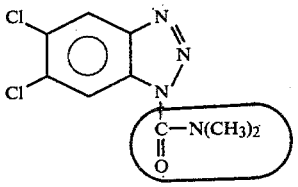

Example 31

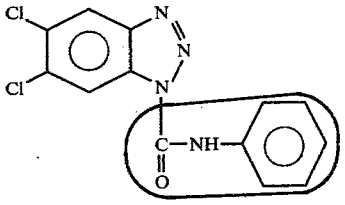

EXAMPLES 32–35—THIOLATE PRECURSORS AS DESTABILIZER MATERIALS

To 8.2 mg of 2-methyl-2-[2-pyridyl]-5-chlorobenzothiazoline were added 24.7 mg of N,N-bis(2-hydroxyethyl)dodecanamide, 63.1 mg of Cohex TFA, 0.7 mg of 2,4-bis(trichloromethyl)-6-[p-methoxystyryl]-S-triazine, 9.5 mg of 2,4-bis(trichloromethyl)-6-[p-anisyl]-S-triazine, 114.4 mg of phthalaldehyde, 30.4 mg of SF-1066 surfactant and 3.6 g of 17% poly(ethylene-co-1,4-cyclohexylene-dimethylene-1-methyl-2,4-benzenedisulfonamide) in acetone. For Example 32, this dope was coated with a 150-micron doctor blade on subbed poly(ethylene terephthalate) support and dried. This basecoat was then overcoated with a 5% solution of poly(acrylamide-co-N-vinyl-2-pyrrolidone-co-2-acetoacetoxy-ethylmethacrylate) in water with 0.05% surfactant 10 G coating aid using a 50-micron doctor blade and dried. A sample of the film coating was then exposed through a silver master for 8 seconds on an IBM Microcopier IID device and dye-developed by heating in a 155° C. Canon Kalfile processor for 5.5 seconds. A black, positive image of neutral D-min 0.12 and D-max 3.2 was produced.

Example 32 was repeated, Examples 33–35, except that the destabilizer material was, respectively, 2-methyl-2-carboxamidothiazolidine, 2-methyl-2-[2-pyridyl]-benzothiazoline, and 2-methyl-2-[4-nitrophenyl]benzothiazoline. When tested at equivalent chemical levels and similar exposure and processing conditions, these materials also yielded satisfactory results.

EXAMPLES 36–41—USE OF BLOCKED MERCAPTOTETRAZOLES AS DESTABILIZER MATERIALS 0.037 mmoles of a mercaptotetrazole of Table IV, 29.9 mg of N,N-bis(2-hydroxyethyl) dodecanamide, 69.0 mg of Cohex TFA, 0.8 mg of 2,4-bis(trichloromethyl)-6-[p-methoxystyryl]-S-triazine, 11.5 mg of 2,4-bis(trichloromethyl)-6-[p-anisyl]-S-triazine, 138.5 mg of phthalaldehyde, and 36.8 mg of SF-1066 surfactant were added to 3.7 g of 12% poly(ethylene-co-1,4-cyclohexylene-dimethylene-1-methyl-2,4-benzenedisulfonamide) in acetone. This dope was coated with a 150-micron doctor blade on a subbed poly(ethylene terephthalate) support and dried. This basecoat was then overcoated with a 4.7% solution of poly(acrylamide-co-N-vinylpyrrolidone-co-2-acetoacetoxy-ethylmethacrylate) in water with a 0.05% surfactant 10 G coating aid using a 50-micron doctor blade and dried. A sample of the film coating was exposed through a silver master for 2 seconds on an IBM Microcopier IID device and dye-developed by heating on a 170° C. hot block for 10 seconds, support side down. For Example 36, a brownish, positive image was produced with a (blue) D-min 0.19 and D-max 0.90. Film coatings of the other Examples, using equivalent amounts of chemicals with similar exposures and processing, yielded comparable results.

TABLE IV

Mercaptotetrazoles

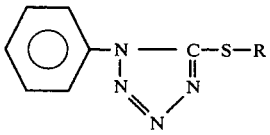

| Example | R |
|---|---|
| 36 | $-COCH_2CH_2SO_2C_7H_7$ |
| 37 | 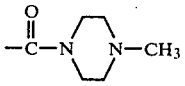 |
| 38 | 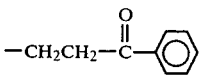 |
| 39 | $-CH_2CH_2CN$ |
| 40 | 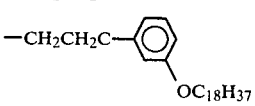 |

TABLE IV-continued

Mercaptotetrazoles

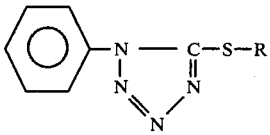

| Example | R |
|---|---|
| 41 | 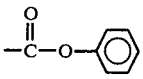 |

EXAMPLES 42–43—USE OF CYCLIC IMIDES AS DESTABILIZER MATERIALS

In 2 g of a 20% solution of poly(ethylene-co-1,4-cyclohexylene-dimethylene-1-methyl-2,4-benzenedisulfonamide) in 95:5 acetone:$H_2O$ were dissolved 40 mg of Cohex TFA, 48 mg o-phthalaldehyde, 5 mg succinimide, and 30 mg iodoform. This dope was coated with a 100-micron doctor blade on a subbed poly(ethylene terephthalate) support. This film was exposed through a silver master for 0.5 seconds on an IBM Microcopier IID device and dye-developed by heating for 10 seconds face-up on a 145° C. hot block. A black positive image with a neutral density of 1.4 and a D-min of 0.04 was formed.

In 10 gms of a 20% solution of poly(ethylene-co-1,4-cyclohexylene-dimethylene-1-methyl-2,4-benzenedisulfonamide) in acetone were dissolved 200 mg of Cohex TFA, 400 mg phthalaldehyde, 25 mg 5,5-diphenylhydantoin and 20 mg 2,6-bis(trichloromethyl)-6-p-methoxystyryl-s-triazine. This dope was coated as in Example 42 and aged for one week to allow sensitometry to stabilize. A sample was exposed through a silver master for four seconds in the IBM Microcopier IID device. Ten seconds dye-development by heating on a 140° C. hot block produced a black positive image with a density of 2.05. D-min was 0.05.

EXAMPLE 44—USE OF A BARBITURATE AS A DESTABILIZER MATERIAL

A stock solution was prepared by adding 798 mg of Cohex TFA, 1.6 g of phthalaldehyde, and 60 mg of 2,4-bis-(trichloromethyl-6-p-anisyl-S-triazine to 30 g of 20% solution of poly(ethylene-co-1,4-cyclohexylenedimethylene-1-methyl-2,4-benzenedisulfonamide) in acetone.

In 1 g of acetone were dissolved 3 mg of 5-n-butylbarbituric acid. 0.1 g of this solution was then added to 1.9 g of the stock solution, coated, overcoated, exposed, and processed as in Example 7 to give a positive image of D-max=3.9 and D-min=0.1.

EXAMPLE 45—USE OF A QUINONE PHOTOREDUCTANT AS A DESTABILIZER MATERIAL

A stock solution was prepared as follows:

75 mg of Cohex TFA and 60 mg 2-(N-ethyl-N-benzylamino)-3chloro-1,4-naphthoquinone, a photoreductant, were dissolved in 1.7 g of 2-methoxyethanol. To this in acetone 3.4 g of a 15 percent solution of cellulose acetate butyrate was added.

A quantity of 40 mg of iodoform was dissolved in 1 g of chloroform. To this solution, a quantity of 2 g of the stock solution was added. The resulting solution was coated with a 100-micron doctor blade on a subbed poly(ethylene terephthalate) support.

A sample of this film was exposed for 2 minutes through a silver test object on a U.V. exposing device, available commercially as a Canon Kalfile Printer 340VC. This exposure imagewise generated by inhibitor. The film was then given an overall 30-second exposure to tungsten light using a Nashua 120 Multi-Spectrum Copier to photogenerate reductant. The exposed film was placed in face-to-face contact with a diazo recording element (commercially available under the trade name Kodak Diazo Type M) and the sandwich was passed twice at 76.2 cm per minute through a set of rollers heated to a temperature of 100° C. A positive image with a maximum red density of 1.0 and minimum red density of 0.07 developed. (The heating step was used to increase the dye-development reaction initiated by the overall exposure.)

EXAMPLES 46–47—USING A QUINONE PHOTOREDUCTANT TO BE EITHER POSITIVE- OR NEGATIVE-WORKING

In 1 g of dioxane were dissolved 120 mg of iodoform and 25 mg of 2-dibenzylamino-3-chloro-1,4-naphthoquinone. To this solution was added a second solution consisting of 120 mg of Cohex TFA and 166 mg phthalaldehyde in a 20% solution of poly(ethylene-co-1,4-cyclohexylenedimethylene-1-methyl-2,4-benzenedisulfonamide) in 95:5 by volume acetone:$H_2O$. This dope was coated with a 100-micron doctor blade on subbed poly(ethylene terephthalate) support and overcoated wtih a 10% solution of (copolyester 1,1,3-trimethyl-5-carboxy-3-(p-carboxyphenyl)indan bisphenol A) in toluene.

The dried coating was exposed for 0.5 seconds on an IBM Microcopier IID device through a silver master and a Wratten 2A filter. Upon heating for 15 seconds face-up on a 140° C. hot block, a dense black negative image was formed.

Example 47 comprised a repetition of the coating of Example 46, which was exposed for 6 seconds through a silver master and a Wratten 34 filter and then followed by a 0.5 seconds dye-development exposure through a Wratten 2A filter. Fifteen seconds of heating face-up on a 140° C. hot block developed a dense positive image.

COMPARATIVE EXAMPLES (C.E.)

C.E. No. 1

Example 13 was repeated except that anilinium methanebisulfonyl acetate was tested as a potential destabilizer material. This was found to be incompatible inasmuch as it caused precipitation of the cobalt(III) complex.

C.E. Nos. 2 and 3

Example 11 was repeated except that the urea of Example 11 was replaced by, respectively,

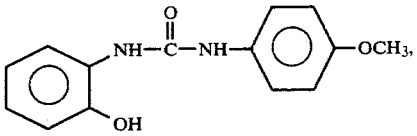

or

-continued

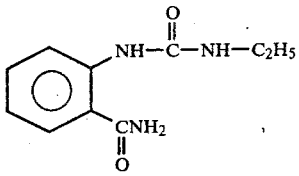

No image discrimination was found in either example, demonstrating that these compounds are not acceptable destabilizer materials.

The invention has been described in detail with particular reference to certain preferred embodiments thereof, but it will be understood that variations and modifications can be effected within the spirit and scope of the invention.

What is claimed is:

1. In an imaging element comprising, in one or more operatively associated layers, an energy-activatible image precursor composition including at least a cobalt(III) complex containing releasable ligands selected from amines, dimethylglyoxime, ethyl, aquo, chloro, bromo, acetylacetonato, nitro, and superoxo, and an image-forming material capable of generating an image in response to the release of said ligands;

the improvement comprising, in reactable association with said precursor composition, a photoinhibitor composition capable of inhibiting said ligand release upon exposure to activating radiation of a wavelength longer than about 300 nm, said photoinhibitor composition containing a photolytic acid-generating compound.

2. An element as defined in claim 1, wherein said photoinhibitor composition includes a heterocyclic compound.

3. An element as defined in claim 1, wherein said photoinhibitor composition is a compound having the formula:

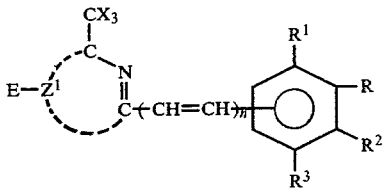

wherein:

R is hydrogen, halide, nitro or alkyl, dialkylamino, or alkoxy containing from 1 to 5 carbon atoms in the alkyl portion, $R^1$ is hydrogen or alkoxy containing from 1 to 5 carbon atoms in the alkyl portion, $R^2$ is hydrogen or alkoxy containing from 1 to 5 carbon atoms in the alkyl portion, or together with $R^3$ comprises the necessary nonmetallic atoms to complete an aromatic ring;

$R^3$ is hydrogen, or together with $R^2$ comprises the necessary nonmetallic atoms to complete an aromatic ring;

$Z^1$ is from about 3 to about 7 ring atoms necessary to complete one or more aromatic rings;

E is H, $CH_3$ or $CX_3$;

n is 0, 1 or 2;

and X is halide.

4. An element as defined in claim 1, wherein said complex becomes thermally unstable at an instability temperature greater than about 100° C. so that said ligands are releasable in response to a thermal exposure sufficient to heat said element to a temperature in excess of said instability temperature.

5. An element as defined in claim 1, wherein said complex is thermally stable at a temperature at least as high as about 130° C.

6. An element as defined in claim 1, wherein said image precursor composition includes a reducing agent for said complex and said ligands are releasable in response to a thermal exposure.

7. An element as defined in claim 1, wherein said image precursor composition includes a reducing agent precursor capable of forming, in the presence of an amine, a reducing agent for said complex, and an amine precursor capable of forming an amine in response to a thermal exposure.

8. An element as defined in claim 7, wherein said reducing agent precursor is phthalaldehyde.

9. An element as defined in claim 1, wherein said image precursor composition includes a base precursor capable of forming a base in response to a thermal exposure.

10. An element as defined in claim 1, wherein said image-forming material is capable of forming a dye in response to said release of ligands.

11. An element as defined in claim 10, wherein said material includes phthalaldehyde.

12. In an imaging element comprising, in one or more operatively associated layers, an energy-activatible image precursor composition including at least a cobalt(III) complex containing releasable liqands selected from amines, dimethylglyoxime, ethyl, aquo, chloro, bromo, acetylacetonato, nitro, and superoxo, an image-forming material capable of generating an image in response to the release of said ligands, and a reducing agent precursor capable of producing a reducing agent for said complex in response to a thermal exposure;

the improvement comprising, in reactable association with said composition, a photoinhibitor composition capable of inhibiting said liqand release upon exposure to activating radiation of a wavelength longer than about 300 nm, said photoinhibitor composition containing a photolytic acid-generating compound.

13. An element as defined in claim 12, wherein said reducing agent precursor is a quinone photoreductant and said exposure of said image precursor composition comprises a light exposure.

14. An element as defined in claim 1, wherein said image precursor composition includes a thiolate precursor;

and said exposure of said image precursor composition comprises a thermal exposure.

15. In a radiation-sensitive element comprising in one or more operatively associated layers, a heat-activatible image precursor composition including at least a cobalt(III) complex containing releasable ligands selected from amines, dimethylglyoxime, ethyl, aquo, chloro, bromo, acetylacetonato, nitro, and superoxo, and an image-forming material capable of generating an image in response to the release of said ligands;

the improvement comprising, in reactable association with said precursor composition, a photoinhibitor composition capable of inhibiting said ligand release upon exposure to activating radiation of a wavelength longer than about 300 nm, said photoinhibitor composition containing a photolytic acid-generating compound.

16. An element as defined in claim 15, wherein said photoinhibitor composition includes a hetrocyclic compound.

17. An element as defined in claim 15, wherein said photoinhibitor composition is a compound having the formula:

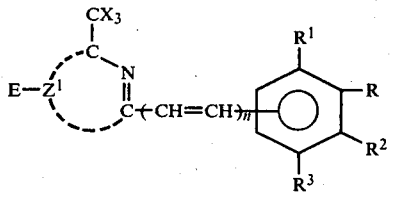

wherein:

R is hydrogen, halide, nitro or alkyl, dialkylamino, or alkoxy containing from 1 to 5 carbon atoms in the alkyl portion, $R^1$ is hydrogen or alkoxy containing from 1 to 5 carbon atoms in the alkyl portion, $R^2$ is hydrogen or alkoxy containing from 1 to 5 carbon atoms in the alkyl portion, or together with $R^3$ comprises the necessary nonmetallic atoms to complete an aromatic ring;

$R^3$ is hydrogen, or together with $R^2$ comprises the necessary nonmetallic atoms to complete an aromatic ring;

$Z^1$ is from about 3 to about 7 ring atoms necessary to complete one or more aromatic rings;

E is H, $CH_3$ or $CX_3$;

n is 0, 1 or 2;

and X is halide.

18. An element as defined in claim 15, wherein said complex becomes thermally unstable at an instability temperature greater than about 100° C. so that said ligands are releasable in response to a thermal exposure sufficient to heat said element to a temperature in excess of said instability temperature.

19. An element as defined in claim 15, wherein said complex is thermally stable at a temperature at least as high as about 130° C.

20. An element as defined in claim 15, wherein said image precursor composition includes a reducing agent.

21. An element as defined in claim 15, wherein said image precursor composition includes a reducing agent precursor capable of forming a reducing agent for said cobalt complex in response to a thermal exposure.

22. An element as defined in claim 15, wherein said image precursor composition includes a reducing agent precursor capable of forming, in the presence of an amine, a reducing agent for said complex, and an amine precursor capable of forming an amine in response to a thermal exposure.

23. An element as defined in claim 22, wherein said reducing agent precursor is phthalaldehyde.

24. An element as defined in claim 15, wherein said image precursor composition includes a base precursor capable of forming a base in response to a thermal exposure.

25. In an imaging element comprising, in one or more operatively associated layers, a reducible cobalt(III) complex containing amine ligands, o-phthalaldehyde, and a quinone photoreductant capable of reducing said complex upon exposure to activating radiation;

the improvement wherein said element further includes an S-triazine having the formula:

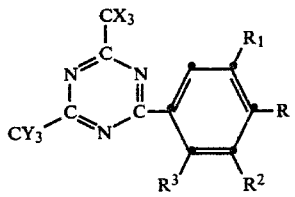

wherein:

R is hydrogen, halide, nitro or alkyl, dialkylamino, or alkoxy containing from 1 to 5 carbon atoms in the alkyl portion, $R^1$ is hydrogen or alkoxy containing from 1 to 5 carbon atoms in the alkyl portion, $R^2$ is hydrogen or alkoxy containing from 1 to 5 carbon atoms in the alkyl portion, or together with $R^3$ comprises the necessary nonmetallic atoms to complete an aromatic ring;

$R^3$ is hydrogen, or together with $R^2$ comprises the necessary nonmetallic atoms to complete an aromatic ring;

X and Y are the same or different, and are each selected from the group consisting of halide and hydrogen, at least one of X and Y being halide.

26. An element as defined in claim 25, wherein said complex is cobalt(III) hexa-ammine trifluoroacetate; said photoreductant is 2-isopropoxy-3-chloro-1,4-naphthoquinone; and said triazine is 2,4-bis(trichloromethyl)-6-[p-anisyl]-S-triazine.

27. In an energy-activatible image precursor composition comprising at least a cobalt(III) complex containing releasable ligands selected from amines, dimethylglyoxime, ethyl, aquo, chloro, bromo, acetylacetonato, nitro, and superoxo, and an image-forming material capable of generating an image in response to the release of said ligands;

the improvement comprising, in reactable association with said precursor composition, a photoinhibitor composition capable of inhibiting said ligand release upon exposure to activating radiation of a wavelength longer than about 300 nm, said photoinhibitor composition containing a photolytic acid-generating compound.

28. A composition as defined in claim 27, wherein said photoinhibitor composition includes a heterocyclic compound containing a chromophore substituent.

29. A composition as defined in claim 28, wherein said photoinhibitor composition is a compound having the formula

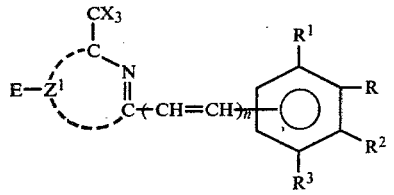

wherein:

R is hydrogen, halide, nitro or alkyl, dialkylamino, or alkoxy containing from 1 to 5 carbon atoms in the alkyl portion, $R^1$ is hydrogen or alkoxy containing from 1 to 5 carbon atoms in the alkyl portion, $R^2$ is hydrogen or alkoxy containing from 1 to 5 carbon atoms in the alkyl portion, or together with $R^3$ comprises the necessary nonmetallic atoms to complete an aromatic ring;

$R^3$ is hydrogen, or together with $R^2$ comprises the necessary nonmetallic atoms to complete an aromatic ring;

$Z^1$ is from about 3 to about 7 ring atoms necessary to complete one or more aromatic rings;

E is H, $CH_3$ or $CX_3$;

n is 0, 1 or 2;

and X is halide.

30. A composition as defined in claim 27, wherein said complex becomes thermally unstable at an instability temperature greater than about 100° C., so that said ligands are releasable in response to a thermal exposure sufficient to heat said element to a temperature in excess of said instability temperature.

31. A composition as defined in claim 27, wherein said complex is thermally stable at a temperature at least as high as about 130° C.

32. A composition as defined in claim 27, and further including a reducing agent, said ligands being releasable in response to a thermal exposure.

33. A composition as defined in claim 27, and further including a reducing agent precursor capable of forming, in the presence of an amine, a reducing agent for said complex, and an amine precursor capable of forming an amine in response to a thermal exposure.

34. A composition as defined in claim 33, wherein said reducing agent precursor is phthalaldehyde.

35. A composition as defined in claim 33, wherein said image-forming material includes a material capable of forming a dye in response to said production of amines.

36. A composition as defined in claim 35, wherein both said reducing agent precursor and said material are phthalaldehyde.

37. A composition as defined in claim 27, and further including a base precursor capable of forming a base in the presence of heat.

38. A composition as defined in claim 27, in dried form, and a support to which said composition is applied to form an imaging element.

39. A composition as defined in claim 27, and further including a reducing agent precursor capable upon exposure of forming a reducing agent for said complex.

40. A composition as defined in claim 39, wherein said precursor is a quinone photoreductant.

41. A composition as defined in claim 39, wherein said precursor comprises a thiolate precursor.

42. In an imaging element comprising, in one or more operatively associated layers, an energy-activatible image precursor composition including at least a cobalt(III) complex containing releasable ligands selected from amines, dimethylglyoxime, ethyl, aquo, chloro, bromo, acetylacetonato, nitro, and superoxo, and an image-forming material capable of generating an image in response to the release of said ligands;

the improvement comprising, in reactable association with said precursor composition, a photoinhibitor composition which, upon exposure to activating radiation of a wavelength longer than about 300 nm, inhibits said ligand release, said photoinhibitor composition containing a photolytic acid-generating compound.

43. A process for forming a negative or positive image in an imaging element comprising, in one or more operatively associated layers, an energy-activatible image precursor composition including at least a cobalt(III) complex containing releasable ligands selected from amines, dimethylglyoxime, ethyl, aquo, chloro, bromo, acetylacetonato, nitro, and superoxo, and an image-forming material capable of generating an image in response to the release of said ligands, and in reactable association with said precursor composition, a photoinhibitor composition capable of inhibiting said ligand release upon exposure to activating radiation of a wavelength longer than about 300 nm, said photoinhibitor composition containing a photolytic acid-generating compound; the process comprising the steps of:

(a) imagewise activating by selective exposure, one of said image precursor composition and said photoinhibitor composition, whereby either ligands are released or are inhibited from release; and (b) overall activating by exposure the other of said compositions, whereby a negative image or a positive image is produced, respectively.

44. A process for forming a positive image in an imaging element comprising, in one or more operatively associated layers, an energy-activatible image precursor composition including at least a cobalt(III) complex containing releasable ligands selected from amines, dimethylglyoxime, ethyl, aquo, chloro, bromo, acetylacetonato, nitro, and superoxo, and an image-forming material capable of generating an image in response to the release of said ligands, and in reactable association with said precursor composition, a photoinhibitor composition capable of inhibiting said ligand release upon exposure to activating radiation of a wavelength longer than about 300 nm, said photoinhibitor composition containing a photolytic acid-generating compound; the process comprising the steps of:

(a) imagewise exposing said element to said activating radiation to inhibit release of said ligands; and (b) overall activating, by exposure to electromagnetic energy, said precursor composition to release said ligands in the portions of said element not exposed to said activating radiation.

45. A process as defined in claim 44, wherein said image precursor composition is thermally activatible, and the step of overall activating said precursor composition to release ligands is achieved by heating said element to a temperature effective to release said ligands.

46. A process for forming a negative image in an imaging element comprising, in one or more operatively associated layers, an energy-activatible image precursor composition including at least a cobalt(III) complex containing releasable ligands selected from amines, dimethylglyoxime, ethyl, aquo, chloro, bromo, acetylacetonato, nitro, and superoxo, and an image-forming material capable of generating an image in response to the release of said ligands, and in reactable association with said precursor composition, a photoinhibitor composition capable of inhibiting said ligand release upon exposure to activating radiation of a wavelength longer than about 300 nm, said photoinhibitor composition containing a photolytic acid-generating compound; the process comprising the steps of:

(a) imagewise selectively activating by exposure to electromagnetic energy, said image precursor composition, to release said ligands imagewise; and (b) overall exposing said element to said activating exposure to inhibit release of ligands in the areas not exposed by the previous step.

47. A process as defined in claim 46, wherein said image precursor composition is thermally activatible and said imagewise activating step is achieved by heating said element to a temperature effective to release said ligands.

48. A process for forming a negative or positive image in an imaging element, comprising first imagewise activating by selective exposure either (a) an image precursor composition in one or more layers, which includes at least a cobalt(III) complex containing releasable ligands selected from amines, dimethylglyoxime, ethyl, aquo, chloro, bromo, acetylacetonato, nitro, and superoxo, and an image-forming material which generates an image in response to release of said ligands, or (b) a layer of a photoinhibitor composition associated with said precursor composition, said photoinhibitor composition being activatible by radiation of a wavelength longer than about 300 nm to inhibit said ligand release and containing a photolytic acid-generating compound.

and then overall activating by exposure the other of said compositions not imagewise activated.

49. A process for forming a negative image in an imaging element, comprising (a) imagewise activating by selective exposure an image precursor composition in one or more layers, which includes at least a cobalt(III) complex containing releasable ligands selected from amines, dimethylglyoxime, ethyl, aquo, chloro, bromo, acetylacetonato, nitro, and superoxo, and an image-forming material which generates an image in response to release of said ligands, and (b) activating by overall exposure to radiation of a wavelength longer than 300 nm, a layer of a photoinhibitor composition associated with said precursor composition and containing a photolytic acid-generating compound that inhibits said ligand release upon said overall exposure.

50. An element as defined in claim 1, wherein said photoinhibitor composition includes a halogenated compound.

* * * * *

UNITED STATES PATENT AND TRADEMARK OFFICE

CERTIFICATE OF CORRECTION

PATENT NO. : 4,273,860

DATED : June 16, 1981

INVENTOR(S) : Anthony Adin

It is certified that error appears in the above-identified patent and that said Letters Patent are hereby corrected as shown below.

Col. 1, line 51, "This" should read --That--.

Col. 4, line 50, before "amplifier", insert --the--; line 57, "coblt(III)" should read --cobalt(III)--.

Col. 5, line 6, after "stable", insert --,--; line 12, "or" (second occurrence) should read --of--; line 30, after "cobalt(II)", insert --to--; line 36, "ammonis", should read --ammonia--; line 39, "embodiment" should read --embodiments--; line 51, "ueutralization rule. useful" should read --neutralization rule. Useful--.

Col. 6, line 18, after "azido;", insert --and those--; line 51, "$(NH_3)$" should read --$(NH_3)_3$--.

Col. 7, line 13, "bis((dimethylglyoxime)ethylaquo cobalt(III)" should read --bis(dimethylglyoxime)ethylaquo cobalt(III)--; line 15, delete the indent at the beginning of the line; line 15, "bipyridy" should read --bipyridyl--.

Cols. 9 and 10, that part of the formula reading

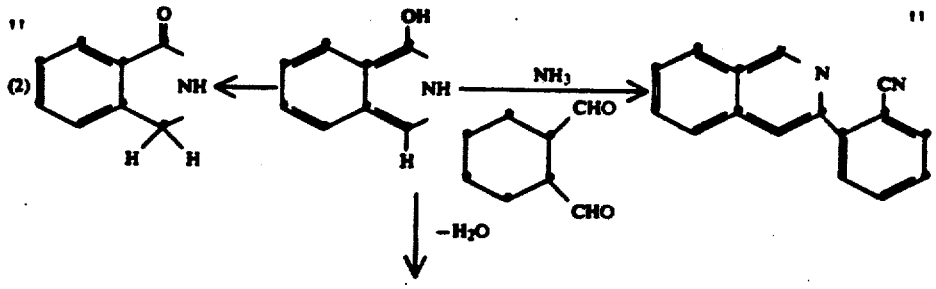

UNITED STATES PATENT AND TRADEMARK OFFICE

CERTIFICATE OF CORRECTION

PATENT NO. 4,273,860

DATED June 16, 1981

INVENTOR(S) Anthony Adin

It is certified that error appears in the above-identified patent and that said Letters Patent are hereby corrected as shown below:

should read

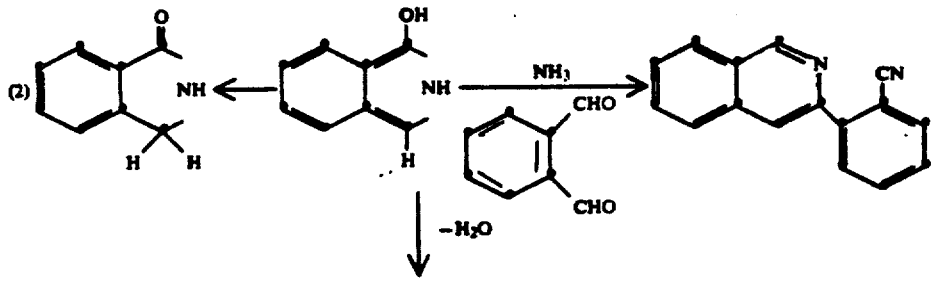

Cols. 11-12, lines 30-33, that part of the formula reading "$\overset{\ominus}{N}$-$\overset{\ominus}{N}$-$CH_2CHCH_2$" should read -- $\overset{\ominus}{N}$-$\overset{\oplus}{N}$-$CH_2CHCH_2$ --;

Col. 11, line 65, "has" should read --is--.

Col. 17, line 25, that part of the formula reading "$C\text{-}(CH{=}CH)_m$" should read -- $C\text{-}(CH{=}CH)_{m'}$ --.

Col. 18, line 32, "PI 4—2,4-" should read -- PI 4—2,4- --;
line 34, "PI 5—2,4-" should read -- PI 5—2,4- --;
line 36, "PI 6—2,4-" should read --PI 6—2,4- --.

Col. 21, line 6, that part of the formula reading "$(CH_2\text{-}CR^{29})_Z$" should read --$(CH_2\text{-}CR^{29})_{Z'}$ --; line 52, "1A" should read --1a--.

UNITED STATES PATENT AND TRADEMARK OFFICE

CERTIFICATE OF CORRECTION

PATENT NO. 4,273,860

DATED June 16, 1981

INVENTOR(S) Anthony Adin

It is certified that error appears in the above-identified patent and that said Letters Patent are hereby corrected as shown below:

Col. 22, line 22, "destabilize" should read --destabilizer--.

Col. 26, line 9, "20" should read --200--; line 10, "200" should read --20--; line 48, "2-carboxycyclohexycarboxamide" should read -- 2-carboxycyclohexylcarboxamide --.

Signed and Sealed this

*Twenty-third* Day of *November 1982*

[SEAL]

*Attest:*

GERALD J. MOSSINGHOFF

*Attesting Officer*

*Commissioner of Patents and Trademarks*